US010779640B2

(12) United States Patent
Allen et al.

(10) Patent No.: US 10,779,640 B2
(45) Date of Patent: Sep. 22, 2020

(54) CANTILEVERED DESK AND COMPONENTS AND METHOD FOR THE USE THEREOF

(71) Applicant: Steelcase Inc., Grand Rapids, MI (US)

(72) Inventors: John Allen, Grand Rapids, MI (US); Matthew Buist, Grand Rapids, MI (US); Colin Cote, Quebec (CA); Megan Grygiel, Wyoming, MI (US); Bradley Youngs, Byron Center, MI (US); Bryan Wahlfield, Grand Rapids, MI (US)

(73) Assignee: STEELCASE INC., Grand Rapids, MI (US)

( * ) Notice: Subject to any disclaimer, the term of this patent is extended or adjusted under 35 U.S.C. 154(b) by 0 days.

(21) Appl. No.: 16/200,250

(22) Filed: Nov. 26, 2018

(65) Prior Publication Data

US 2020/0163452 A1 May 28, 2020

(51) Int. Cl.

| | |
|---|---|
| ***A47B 21/02*** | (2006.01) |
| ***A47B 9/20*** | (2006.01) |
| ***A47B 9/14*** | (2006.01) |
| ***A47B 21/06*** | (2006.01) |

(52) U.S. Cl.

CPC ..... *A47B 21/02* (2013.01); *A47B 9/14* (2013.01); *A47B 9/20* (2013.01); *A47B 21/06* (2013.01); *A47B 2021/066* (2013.01)

(58) Field of Classification Search

CPC ..... A47B 21/00; A47B 21/02; A47B 21/0314; A47B 47/00

USPC ..... 108/147, 50.01, 50.02, 180, 153.1, 154; 312/223.6, 223.3

See application file for complete search history.

(56) References Cited

U.S. PATENT DOCUMENTS

| | | | |
|---|---|---|---|
| 595,425 | A | 12/1897 | Adams |
| 1,520,520 | A | 12/1924 | Thomason |
| 2,342,631 | A | 2/1944 | Hillenbrand |
| 2,382,354 | A | 8/1945 | Wales |
| 2,429,523 | A | 10/1947 | Murphy |
| 2,483,629 | A | 10/1949 | Davis |
| 4,050,752 | A | 9/1977 | Dykstra |
| D265,968 | S | 8/1982 | Bergin |
| 4,381,714 | A | 5/1983 | Henneberg et al. |

(Continued)

FOREIGN PATENT DOCUMENTS

| | | | |
|---|---|---|---|
| CA | 2083851 | A1 | 10/1992 |
| CA | 2177213 | A1 | 12/1996 |

(Continued)

*Primary Examiner* — Jose V Chen

(74) *Attorney, Agent, or Firm* — Brinks Gilson & Lione

(57) ABSTRACT

A desk includes a frame, a coupled to the frame, and a height adjustable support column assembly coupled to the frame with a lower mounting member extending under a bottom edge of the skin and an upper mounting member extending over a top edge of the skin. A worksurface is coupled to the support column assembly and is cantilevered outwardly relative to the support column assembly. A power grommet embedded in the worksurface includes a housing, at least a first and second outlet block disposed in the housing, and a lid pivotally connected to the housing. The lid is pivotable between an open position, wherein the first and second outlet blocks are exposed along a top of the housing, and a closed position, wherein the first outlet block is exposed along a top of the housing and the second outlet block is covered by the lid.

24 Claims, 33 Drawing Sheets

(56) References Cited

U.S. PATENT DOCUMENTS 4,536,612 A 8/1985 Domigan
4,651,652 A 3/1987 Whyckoff
4,654,756 A * 3/1987 Wilson ..... A47B 21/06 312/223.3
4,688,491 A 8/1987 Herrera
4,721,476 A 1/1988 Zeliff
4,734,826 A 3/1988 Wilson et al.
4,762,072 A 8/1988 Boundy et al.
4,792,881 A 12/1988 Wilson et al.
4,805,538 A 2/1989 Fisher et al.
4,852,500 A * 8/1989 Ryburg ..... A47B 21/03 108/105
4,881,471 A 11/1989 Schwartz et al.
4,969,403 A 11/1990 Schwartz et al.
5,224,429 A 7/1993 Borgman et al.
5,259,326 A 11/1993 Borgman et al.
5,322,025 A 6/1994 Sherman et al.
5,323,695 A 6/1994 Borgman et al.
5,373,793 A 12/1994 Crossman
D355,110 S 2/1995 Olson et al.
5,429,431 A 7/1995 Olson
5,522,324 A * 6/1996 van Gelder ..... A47B 21/06 108/50.02
5,558,418 A * 9/1996 Lambright ..... A47B 21/00 312/321.5
5,575,668 A 11/1996 Timmerman
5,598,789 A 2/1997 Jonker
5,709,156 A 1/1998 Gevaert et al.
D392,254 S 3/1998 Gevaert
5,738,422 A * 4/1998 Welborn, Jr. ..... A47B 83/001 312/196
5,743,193 A 4/1998 Kakuta et al.
5,765,932 A 6/1998 Domina et al.
5,778,803 A 7/1998 Machael
D405,051 S 2/1999 Byrne
D405,052 S 2/1999 Byrne
5,878,673 A * 3/1999 Kramer ..... A47B 87/002 108/50.02
D412,698 S 8/1999 Byrne
5,931,429 A 8/1999 Hellwig et al.
5,941,182 A 8/1999 Greene
5,974,983 A 11/1999 Bogucki
5,980,279 A 11/1999 Muller
5,988,076 A * 11/1999 Vander Park ..... A47B 21/06 108/50.02
D420,327 S 2/2000 Byrne
6,023,586 A 2/2000 Gaisford et al.
6,024,599 A 2/2000 Stathis et al.
6,046,405 A 4/2000 Obermann
6,085,667 A 7/2000 Gevaert et al.
6,162,071 A 12/2000 Muller
6,196,140 B1 * 3/2001 Newhouse ..... A47B 13/06 108/147.11
6,202,567 B1 3/2001 Funk et al.
6,254,427 B1 7/2001 Stathis
6,267,064 B1 * 7/2001 Ostertag ..... A47B 13/021 108/108
6,338,301 B1 1/2002 Almond
6,415,723 B1 7/2002 Kopish
6,435,106 B2 8/2002 Funk
D465,201 S 11/2002 Gershfeld
6,484,648 B1 11/2002 Long
D467,230 S 12/2002 Byrne
D468,701 S 1/2003 Byrne
6,629,505 B1 10/2003 Cronk et al.
6,676,231 B1 * 1/2004 Kelley ..... A47B 83/001 108/50.01
6,682,030 B2 1/2004 Santoro et al.
6,840,785 B2 1/2005 Drane
D504,318 S 4/2005 Lane et al.
6,877,442 B2 4/2005 Helle
6,895,868 B1 5/2005 Cronk et al.
6,979,209 B2 12/2005 Griepentrog
6,997,116 B2 2/2006 George et al.
D518,002 S 3/2006 Johanneck et al.
7,045,706 B1 5/2006 Lincoln, III
7,064,275 B2 6/2006 Henriott et al.
D528,822 S 9/2006 Newhouse
D537,039 S 2/2007 Pincek
7,178,469 B2 * 2/2007 Goza ..... A47B 21/0314 108/50.01
7,205,488 B2 4/2007 Riner
7,312,393 B2 12/2007 McCarthy
7,392,068 B2 6/2008 Dayan et al.
7,398,738 B2 * 7/2008 Newhouse ..... A47B 9/18 108/147
D576,118 S 9/2008 Beilstein
7,469,644 B2 * 12/2008 Tseng ..... A47B 1/04 108/158.11
7,605,330 B1 10/2009 Black et al.
7,658,359 B2 2/2010 Jones et al.
7,665,255 B2 * 2/2010 Dressendorfer ..... H02G 3/0456 108/50.02
7,674,119 B1 3/2010 McCarthy
7,806,723 B2 10/2010 Chong et al.
7,901,224 B1 3/2011 Black et al.
D635,922 S 4/2011 Sato
7,926,430 B2 4/2011 Bakker
7,934,459 B2 5/2011 Frazier
7,966,951 B1 * 6/2011 Black ..... H02G 3/128 108/50.01
8,061,864 B2 11/2011 Metcalf et al.
8,074,581 B2 12/2011 Epstein et al.
D660,237 S 5/2012 Byrne
D665,355 S 8/2012 Byrne
D666,556 S 9/2012 Byrne
8,317,537 B1 11/2012 Black et al.
D682,213 S 5/2013 Byrne et al.
8,499,699 B2 8/2013 Rheault et al.
8,720,348 B2 5/2014 Roh
8,752,488 B2 6/2014 Moller
8,770,420 B2 7/2014 Nagaishi et al.
8,800,454 B2 8/2014 Jones
D716,232 S 10/2014 Byrne et al.
8,919,264 B1 12/2014 Lager
D721,330 S 1/2015 Byrne et al.
8,925,469 B2 1/2015 Bennie et al.
D722,563 S 2/2015 Byrne et al.
8,943,978 B2 2/2015 Soper et al.
8,951,054 B2 2/2015 Byrne et al.
8,967,054 B2 * 3/2015 Henriott ..... A47B 13/06 108/50.02
8,985,032 B1 3/2015 Johnson
9,086,313 B2 * 7/2015 Tobia ..... A61B 50/10
9,204,715 B2 12/2015 Bonuccelli
9,257,776 B2 2/2016 Kramer
9,271,569 B2 3/2016 Zaccai et al.
D859,596 S 6/2016 Byrne et al.
9,380,866 B1 7/2016 Davis
9,420,878 B2 8/2016 Lager
D775,080 S 12/2016 Newhouse
9,591,920 B2 3/2017 Jones et al.
9,706,833 B2 7/2017 Newhouse
9,723,918 B2 8/2017 Lager
D799,427 S 10/2017 Newhouse et al.
D807,829 S 1/2018 Byrne et al.
D808,339 S 1/2018 Page et al.
D811,337 S 2/2018 Byrne et al.
2004/0147147 A1 7/2004 Griepentrog
2004/0175975 A1 9/2004 Drane
2004/0194669 A1 * 10/2004 Forslund, III ..... A47B 21/00 108/50.01
2005/0248239 A1 11/2005 Newhouse et al.
2005/0268823 A1 12/2005 Bakker et al.
2005/0279257 A1 * 12/2005 Bettinger ..... A47B 21/0314 108/50.02
2007/0228234 A1 10/2007 Doyle
2008/0028996 A1 * 2/2008 Ooba ..... A47B 13/003 108/10
2009/0029576 A1 1/2009 Shunjie
2009/0071271 A1 3/2009 Nielsen et al.
2009/0165679 A1 7/2009 Bakker et al.

(56) References Cited

U.S. PATENT DOCUMENTS

| | | | | |
|---|---|---|---|---|
| 2009/0273260 | A1* | 11/2009 | Kemp | A47B 21/06 312/223.3 |
| 2009/0293773 | A1* | 12/2009 | Miller | A47B 21/00 108/28 |
| 2010/0024688 | A1* | 2/2010 | Kitada | A47B 21/00 108/50.02 |
| 2011/0177714 | A1 | 7/2011 | Byrne | |
| 2011/0232957 | A1 | 9/2011 | Gretz | |
| 2012/0031310 | A1 | 2/2012 | Jedrysik et al. | |
| 2013/0075557 | A1 | 3/2013 | Hsiao | |
| 2014/0197720 | A1 | 7/2014 | Sorbara et al. | |
| 2014/0245932 | A1* | 9/2014 | Mckenzie, III | A47B 21/02 108/50.01 |
| 2014/0265763 | A1 | 9/2014 | Soper et al. | |
| 2014/0312754 | A1 | 10/2014 | Hecht et al. | |
| 2015/0009652 | A1 | 1/2015 | Alexander et al. | |
| 2015/0320203 | A1 | 11/2015 | Mandon et al. | |
| 2016/0128469 | A1 | 5/2016 | Matthai et al. | |

FOREIGN PATENT DOCUMENTS

| | | | |
|---|---|---|---|
| CA | 2083851 | C | 1/1999 |
| CA | 2177213 | C | 9/2000 |
| DE | 19811475 | | 4/1999 |
| EP | 2664252 | B1 | 7/2017 |
| GB | 833472 | | 4/1960 |
| GB | 2172197 | | 9/1986 |
| GB | 2524164 | | 9/2015 |
| JP | H07017136 | | 3/1995 |
| JP | 10133775 | | 5/1998 |
| JP | 11178176 | | 7/1999 |
| JP | 11-206462 | | 8/1999 |
| JP | 2000116444 | | 4/2000 |
| JP | 2006149733 | | 6/2006 |
| JP | 2006238981 | | 9/2006 |
| WO | WO97/19617 | | 6/1997 |
| WO | WO0021408 | | 4/2000 |
| WO | WO2009039277 | | 3/2009 |
| WO | WO2010/119406 | A1 | 10/2010 |
| WO | WO2016/175241 | | 11/2016 |
| WO | WO2016/175297 | | 11/2016 |
| WO | WO2016/195853 | | 12/2016 |
| WO | WO2017/123228 | A1 | 7/2017 |

* cited by examiner

CANTILEVERED DESK AND COMPONENTS AND METHOD FOR THE USE THEREOF

FIELD OF THE INVENTION

The present disclosure relates generally to a desk, and in particular to a cantilevered desk and components, and methods for the use, assembly and reconfiguration thereof.

BACKGROUND

Workspace systems typically include desks and storage arranged to define a workspace. In some work environments, it may be desirable to maximize the open space beneath a desk, for example by cantilevering a worksurface from a wall or other support structure. Often, the support structure may include a floor engaging member that extends underneath the desk to counterbalance the worksurface, with the floor engaging member obstructing mobility and adversely affecting the open aesthetics of the system. In other systems, the desk is integrated into the support structure, such that the support structure does not have any independent function and use.

At the same time, it may be desirable to make the desk height adjustable, such that a user may position the worksurface for various desired tasks, while maximizing the user's ability to work in different settings, whether sitting or standing. Providing height adjustability to a cantilevered desk may be particularly challenging, however. Typically, such desks are secured to fixed anchor points, such as hanger brackets, which limit the ability of the user to customize the workspace. As such, the need remains for a cantilevered height adjustable desk with maximum clearance and variable positioning.

In addition, height adjustable columns typically include an actuator disposed interiorly of the column. If the actuator malfunctions, or must otherwise be accessed or replaced, the entire support column or worksurface must be removed, with the attendant problem of supporting the worksurface and other integrated structure and control systems.

Desks also may be configured with one or more power grommets, which provide power outlets embedded in the worksurface. Power grommets may be covered, which may obscure the underlying functionality, or uncovered, which may allow for the intrusion of dust, fluids and other debris. Typically, the power grommets do not allow for the pass through of cables, cords and the like between the upper and lower surfaces of the worksurface.

In addition, it is well known to secure a computer monitor or display to the desk, for example with a monitor arm that is clamped to the worksurface. Often, the monitor arm is secured to or around the edge of the worksurface, which exposes the monitor arm, hardware and adjacent passersby to various interactions, while requiring wires and the like connected to the monitor to overrun the edge of the desk. As such, the need remains for an improved power grommet that introduces variant outlet options while also providing a location for securing a monitor inwardly from the edge of the worksurface, or for routing cables between the top and bottom of the worksurface.

SUMMARY

The present invention is defined by the following claims, and nothing in this section should be considered to be a limitation on those claims.

In one aspect, one embodiment of a desk includes a base having a frame with upper and lower frame members extending in a longitudinal direction and opposite sides spaced apart in a lateral direction. A skin includes first and second sides and top and bottom edges. The skin is coupled to the frame, with the first side facing one of the opposite sides of the frame. A height adjustable support column assembly includes a lower mounting member coupled to the lower frame member and an upper mounting member coupled to the upper frame member. The lower mounting member extends under the bottom edge of the skin, while the upper mounting member extends over the top edge of the skin. A worksurface is coupled to the support column assembly and is cantilevered outwardly relative to the support column assembly.

In yet another aspect, one embodiment of a power grommet includes a housing defining an elongated cavity extending in a longitudinal direction, with the cavity being open along a top of the housing. At least first and second outlet blocks are disposed in the cavity and are accessible through the open top of the housing. A lid is pivotally connected to the housing about an axis extending perpendicular to the longitudinal direction. The lid is pivotable between an open position, wherein the first and second outlet blocks are exposed along a top of the housing, and a closed position, wherein the first outlet block is exposed along a top of the housing and the second outlet block is covered by the lid.

In one embodiment, a desk includes an opening defined in a worksurface, with the grommet housing being received in the opening. The first and second outlet blocks are spaced apart, with a through-opening being defined between the top and bottom of the housing and between opposing sides of the spaced apart first and second outlet blocks. The through opening remains exposed when the lid is in the closed position. In one embodiment, a monitor support extends into the through-opening and is clamped to the worksurface.

In another aspect, a height adjustable support column assembly includes a base support and a height adjustable support column supported by the base support. The support column includes telescoping inner and outer tube members moveable along a first axis. A linear actuator is supported by the base support, but is positioned exteriorly of the inner tube member and defines a second axis spaced apart from the first axis in a parallel relationship therewith.

In yet another aspect, a desk includes a height adjustable support column assembly having a height adjustable support column supported by a base support. The support column includes telescoping inner and outer tube members moveable along a first axis. A linear actuator also is supported by the base support. An attachment plate is coupled to a top of the height adjustable support column. A leveling component is disposed between the height adjustable support column and the mounting plate. The leveling component is adjustable between a plurality of positions such that the attachment plate is moveable to a corresponding plurality of angular orientations relative to the top. A worksurface is coupled to the attachment plate.

In yet another aspect, an enclosure includes a housing having a pair of opposite side walls and a lid having a pair of cavities spaced apart along a longitudinal axis. Each of the cavities has a stop surface. A pair of springs are disposed in the cavities and engage the stop surfaces. A pair of pivot members each include a friction surface, with the pair of springs biasing the pivot members away from the stop surface and toward the side walls such that the friction surface of each pivot member engages one of the side walls of the housing. In this way, the lid may be maintained at any pivot position relative to the housing through the applied friction force, thereby requiring the user to exert a force on the lid to open or close the lid.

In yet another aspect, one embodiment of a method of accessing an enclosure includes pivoting a lid relative to a housing about a pivot member from a closed position to an angled open position, and exerting an axial force to the pivot member and thereby creating a friction force between the pivot member and housing sufficient to hold the lid in the angled open position.

The various embodiments of the desk provide significant advantages over other workspace systems, and components used therein. For example and without limitation, the cantilevered worksurface can be moved to a desired height, while maintaining a clear and open space beneath the worksurface. At the same time, the worksurface can be easily and quickly moved to various locations along the length of the frame, thereby allowing the user to easily and quickly reconfigure the workspace without reconfiguring the base or adjusting the aesthetic thereof. Or, the worksurface and height adjustable support column may be removed altogether, allowing the base to be used in a stand-alone configuration.

The height adjustable support column assembly also provides significant advantages. In one embodiment, wherein the linear actuator is disposed exteriorly of the inner tube, the linear actuator can be quickly and easily replaced, accessed and/or repaired without having to remove or the support column or worksurface, or disconnect those components. In this way, maintenance and repairs may be performed with minimal disruption. Moreover, the leveling component allows for the user/installer to adjust the angular positon of the worksurface, which may be particularly important where the worksurface is supported at only one location, or at only one end, in a cantilevered configuration.

The power grommet also provides significant advantages, presenting both covered and uncovered outlets, which communicates to the user the functionality of the grommet while obscuring and protecting at least some of the outlets. In one embodiment, the grommet also provides the ability to secure a monitor arm to the worksurface without engaging an edge of the worksurface, and/or route cables/cords/lines between the upper and lower surfaces of the worksurface, thereby eliminating the possibility of snagging the monitor arm or associated power/utility cords and lines.

The foregoing paragraphs have been provided by way of general introduction, and are not intended to limit the scope of the following claims. The various preferred embodiments, together with further advantages, will be best understood by reference to the following detailed description taken in conjunction with the accompanying drawings.

DETAILED DESCRIPTION OF THE PRESENTLY PREFERRED EMBODIMENTS

Figure 1:
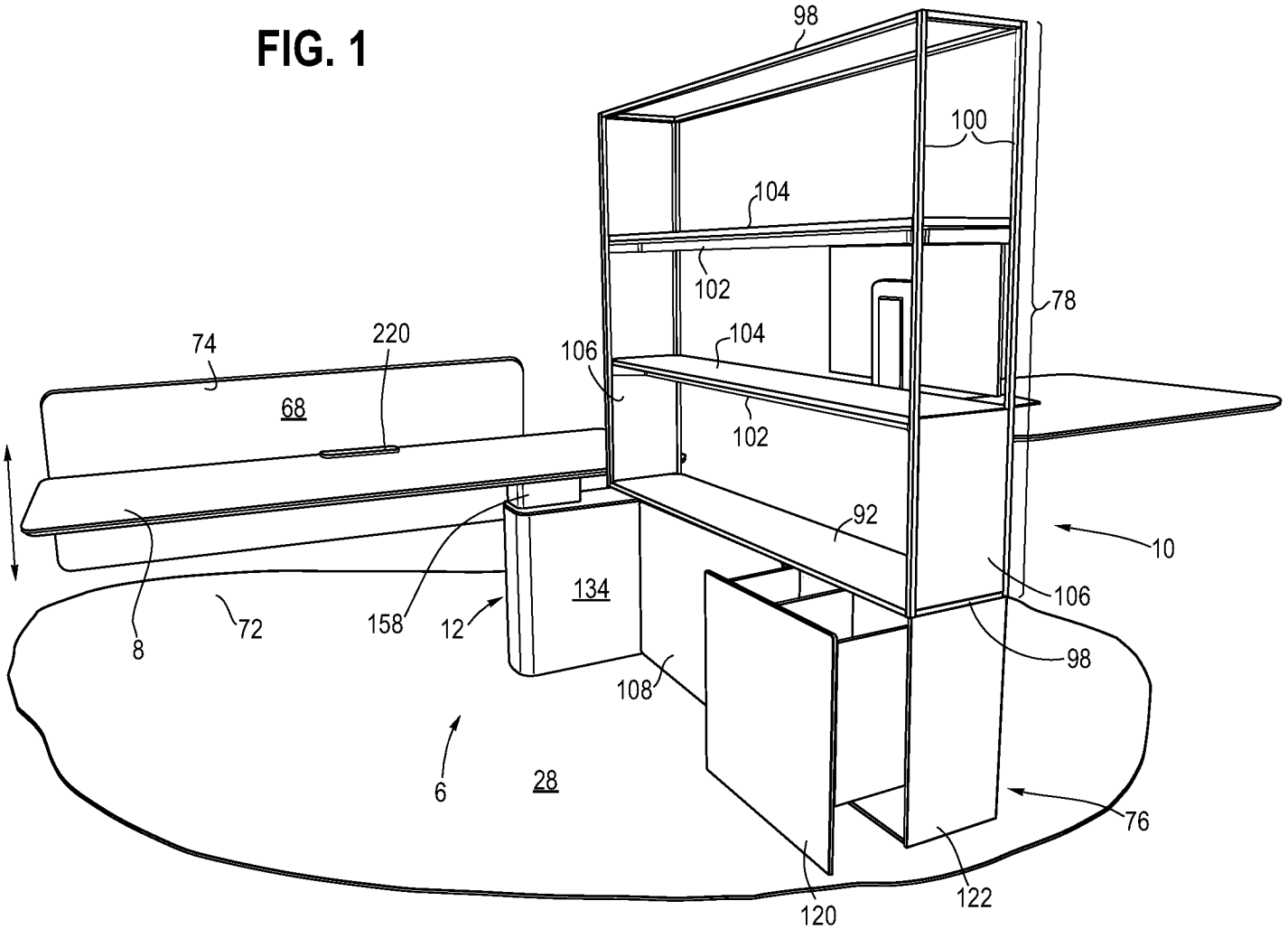
FIG. 1 is a perspective view of one embodiment of a desk including a cantilevered worksurface.

It should be understood that the term "plurality," as used herein, means two or more. The terms "longitudinal" as used herein means of or relating to length or the lengthwise direction 2, 2', 2", for example between the opposite ends or side edges of a desk or base component, or between upper and lower ends of a support column. As such, the longitudinal direction 2' associated with a worksurface may be orthogonal to the longitudinal direction associated with a base 10 when those components are arranged in an orthogonal relationship as shown for example in FIG. 2A. The terms "lateral" and "transverse" as used herein, means situated on, directed toward or running from side to side (front and back of a worksurface), and refers to a lateral direction 4, 4', 4" transverse to the longitudinal direction. The term "coupled" means connected to or engaged with whether directly or indirectly, for example with an intervening member, and does not require the engagement to be fixed or permanent, although it may be fixed or permanent (or integral), and includes both mechanical and electrical connection. The terms "first," "second," and so on, as used herein are not meant to be assigned to a particular component so designated, but rather are simply referring to such components in the numerical order as addressed, meaning that a component designated as "first" may later be a "second" such component, depending on the order in which it is referred. For example, a "first" side may be later referred to as a "second" side depending on the order in which they are referred. It should also be understood that designation of "first" and "second" does not necessarily mean that the two features, components or values so designated are different, meaning for example a first side may be the same as a second side, with each simply being applicable to separate but identical components.

Cantilevered Desk:

Referring to FIGS. 1-6, a cantilevered desk 6 includes a base 10, a height adjustable support column assembly 12 and a worksurface 8. It should be understood that FIGS. 1-6 provide an illustration of one embodiment of an ornamental design appearance, and that various embodiments with different and other ornamental appearances may serve the same functions as the disclosed embodiment. The worksurface has opposite side edges 14, a front edge 16, a rear edge 18, a top surface 20 and a bottom surface 22. The worksurface is cantilevered outwardly from the support column assembly, which is connected to the base. The base provides a mass that counterbalances the worksurface, and/or any loads applied to a distal end portion 24 thereof. The term "cantilevered" as used herein refers to the worksurface 8 projecting from the support column assembly 12, with the worksurface being supported only at one end by the support column assembly, with an unsupported length L1 of the worksurface 8 being between and including at least 50% and 90%, and more preferably between and including 50% and 80%, of the overall length L2 of the worksurface defined between the opposite side edges 14. The unsupported length L1 is defined between the side edge 14 at the distal end portion 24 and a vertical plane 26 defined at the outermost (closest to the side edge at the distal end portion) floor engaging portion of the support column assembly 12 underlying the worksurface, or the outermost extent of any other structure supporting the worksurface and engaging the floor 28. In various embodiments, L1/L2 is between and including 50% and 60%, between and including 60% and 70%, between and including 70% and 80%, or between and including 80% and 90%, and is 74% in one preferred embodiment.

Figure 2A:
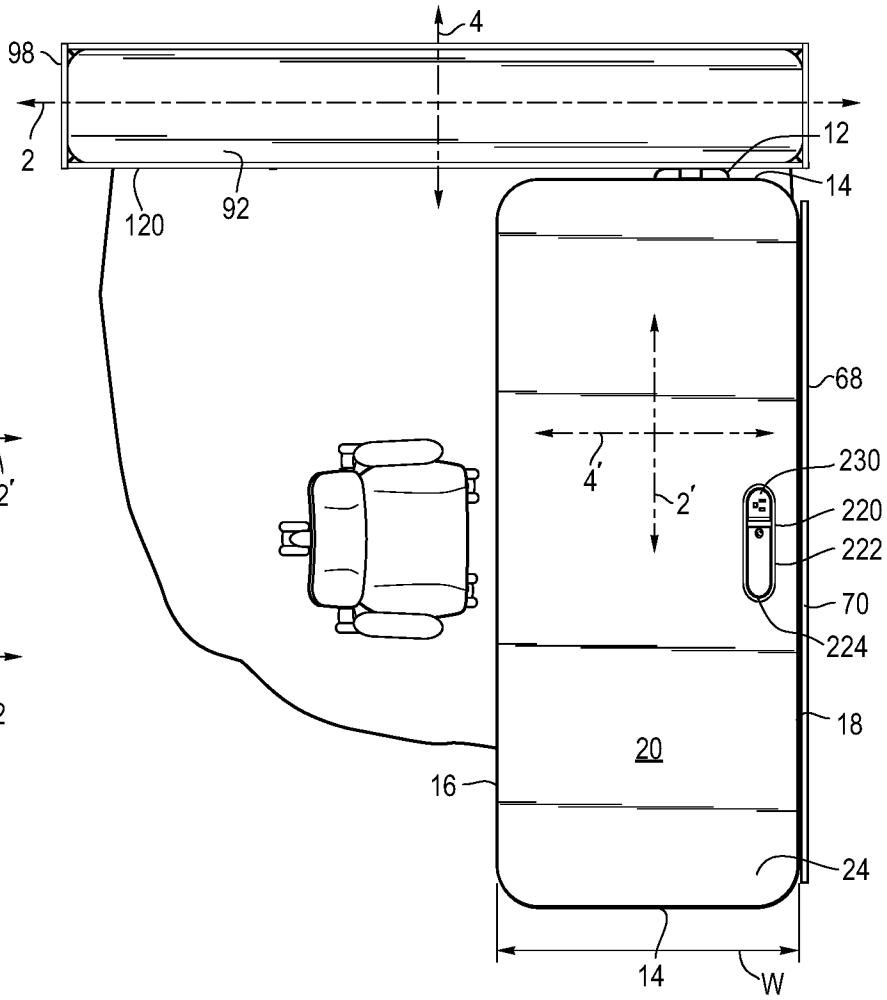
FIGS. 2A and B are top views of a desk with the worksurface located in orthogonal first and second cantilevered positions.
Figure 2B:
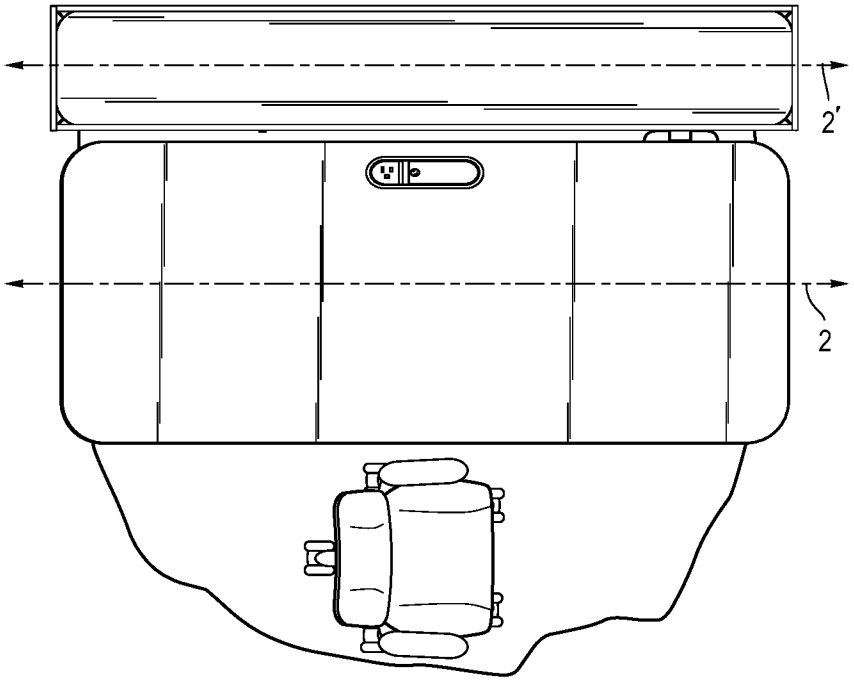

As shown in in FIGS. 2A and 2B, the worksurface 8, or longitudinal length 2' thereof between the side edges 14 (otherwise referred to as ends), may extend orthogonal to the longitudinal length or direction 2 of the base 10 as shown in FIG. 2A, or parallel to the longitudinal length 2 as shown in FIG. 2B. The worksurface may be made of wood, particle board, glass, solid surface materials, or combinations thereof. In one embodiment, the length L2 of the worksurface is between about 46 to 72 inches, while the width/depth W of the worksurface is between about 29 and 36 inches and the thickness of the worksurface is between about 0.5 to 0.75 inches.

Figure 14A:
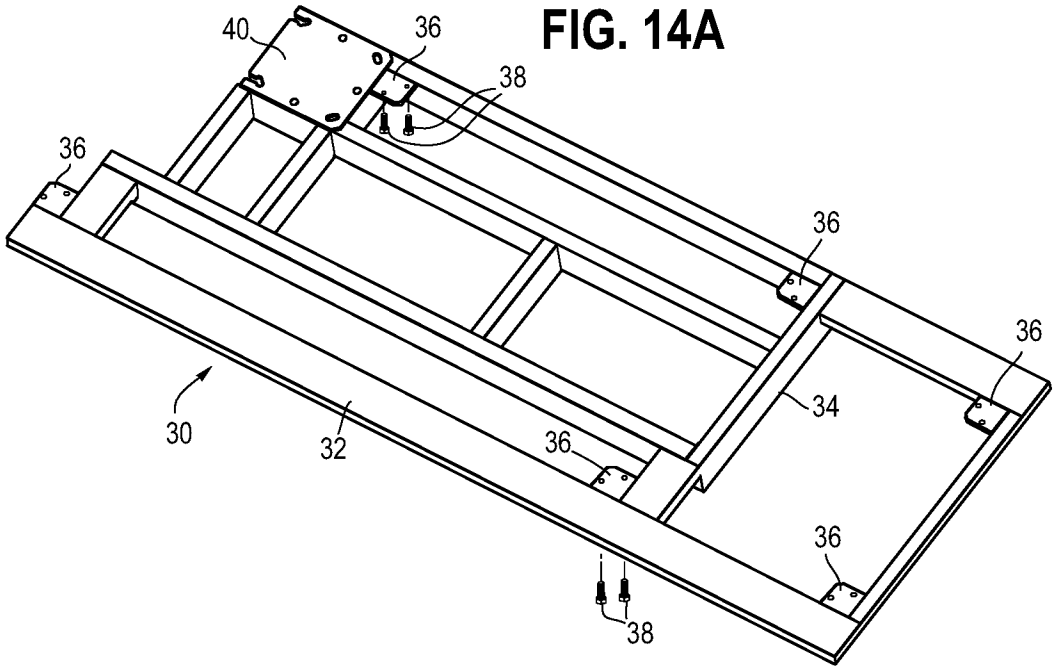
FIG. 14A is a perspective view of a worksurface understructure.

The worksurface is coupled to an understructure 30, shown in FIGS. 14A and B and 38. In one embodiment, shown in FIGS. 14A and B, the understructure includes a frame having longitudinal and lateral frame members 32, 34, made for example of steel tubing, including various rectangular/square tubing dimensions of 1 inch by 2.5 inches, 1 inch by 1 inch and/or 1 inch by 1.5 inches. The understructure supports, rigidifies and minimizes the amount of deflection of the cantilevered worksurface when loaded on the unsupported distal end portion 24. The worksurface is coupled to mounting plates 36 with screws 38 or other fasteners, adhesives and/or combinations thereof. The mounting plates 36 are coupled to the frame members 32, 34, for example by welding.

Figure 14B:
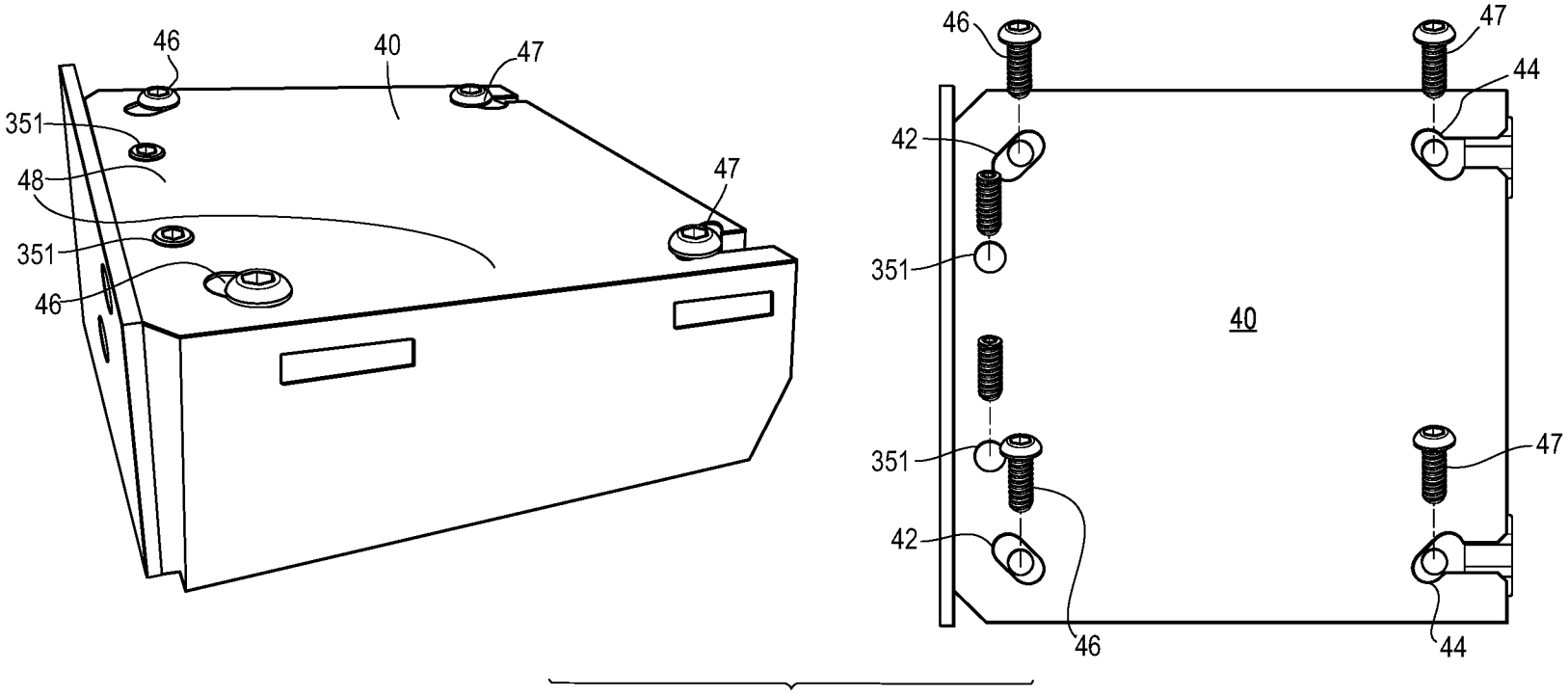
FIG. 14B is an enlarged, partial top view of the understructure.
Figure 38:
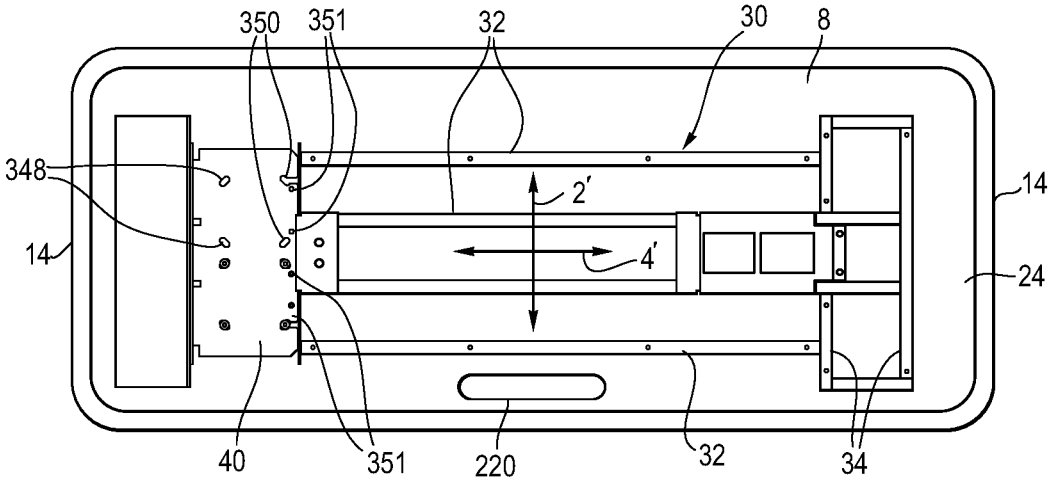
FIG. 38 is a bottom view of the worksurface and understructure.

An attachment plate 40 is coupled to the understructure 30, for example by welding, fasteners, or combinations thereof. As shown in the embodiment of FIG. 38, a pair of attachment plates are offset on opposite sides of a longitudinal centerline of the understructure 30, or may be combined as a single elongated plate having portions disposed on both sides of the longitudinal centerline. The plate(s) 40 may be defined by the upper web of a bracket having side flanges. Referring to FIGS. 14A and B, the plate has at least four openings 42, 44, through which bolts 46, 47, or other fasteners are secured to an underlying support column. In the embodiment of FIG. 38, the single elongated plate has two sets of four openings, one set on each side of the longitudinal centerline. The attachment plate 40 is preferably made of metal, for example steel. Initially, two bolts 46 are secured to the support column 126 as described herein, but with a shank of the bolt being exposed. Two of the four openings 44 are slotted, allowing the plate and understructure to slide into engagement with the exposed shank of the bolts 47, with the understructure in either the orthogonal or parallel orientation (see FIGS. 2A and B respectively). As shown in the embodiment of FIG. 38, one side of the elongated plate 40 is selected for attachment to the support column. Two bolts 47 are inserted through openings in the plate 40 and engaged with the support column. A level (e.g., bubble level) is positioned on the understructure in the longitudinal direction 2', and a leveling component, e.g., set screws 351 extending through openings in the plate 40 as shown in FIGS. 14B and 38, are adjusted until there is a slight bias upwards at the distal end 24. The level is then rotated to the lateral direction 4', with the one or more leveling components (e.g., set screws 351) being adjusted to level the understructure. In this way, the pair of set screws 351 provide for leveling adjustment in both the longitudinal and lateral directions. The leveling component 351 is disposed between the attachment plate 40 and support column assembly 12, and in particular a top surface of the outer tube 160, and may be adjusted to vary the angle of the attachment plate 40 and understructure 30 relative to the adjacent support column assembly 12 and base 10 to ensure that worksurface 8 is level relative to the base 10 when loaded, for example at the distal end portion 24. In one embodiment, the leveling component is configured as at least one set screw, including in one embodiment a pair of set screws 351, which interface between the attachment plate 40 and the support column assembly 12, and in particular the upper surface of the outer tube 160, for example at a pair of landings extruded along one of the walls. Once the desired angle of the understructure and worksurface is achieved, the two bolts 47 may be tightened, and the remaining two bolts 46 installed to secure the understructure to the support column. The worksurface may thereafter be installed on the understructure by securing fasteners 38 through the mounting plates 36.

As shown in FIGS. 3-6, a cover 52 may be secured to the understructure, the bottom of the worksurface and/or to plates disposed on top of the understructure. The cover may be made of polyethylene terephthalate (PET). The cover has a tapered end wall 54 under the distal portion 24, a tapered front wall 56, an opposite end wall 58, a rear wall 60 and a bottom wall 62. The cover 52 covers the understructure 30 to provide a pleasing aesthetic appearance. An interior surface 64 of the cover is spaced apart from the bottom 22 of the worksurface, and defines a cavity 66 therebetween in which cables, wires and other components may be stored and/or routed, as shown for example in FIGS. 6 and 18.

Figure 3:
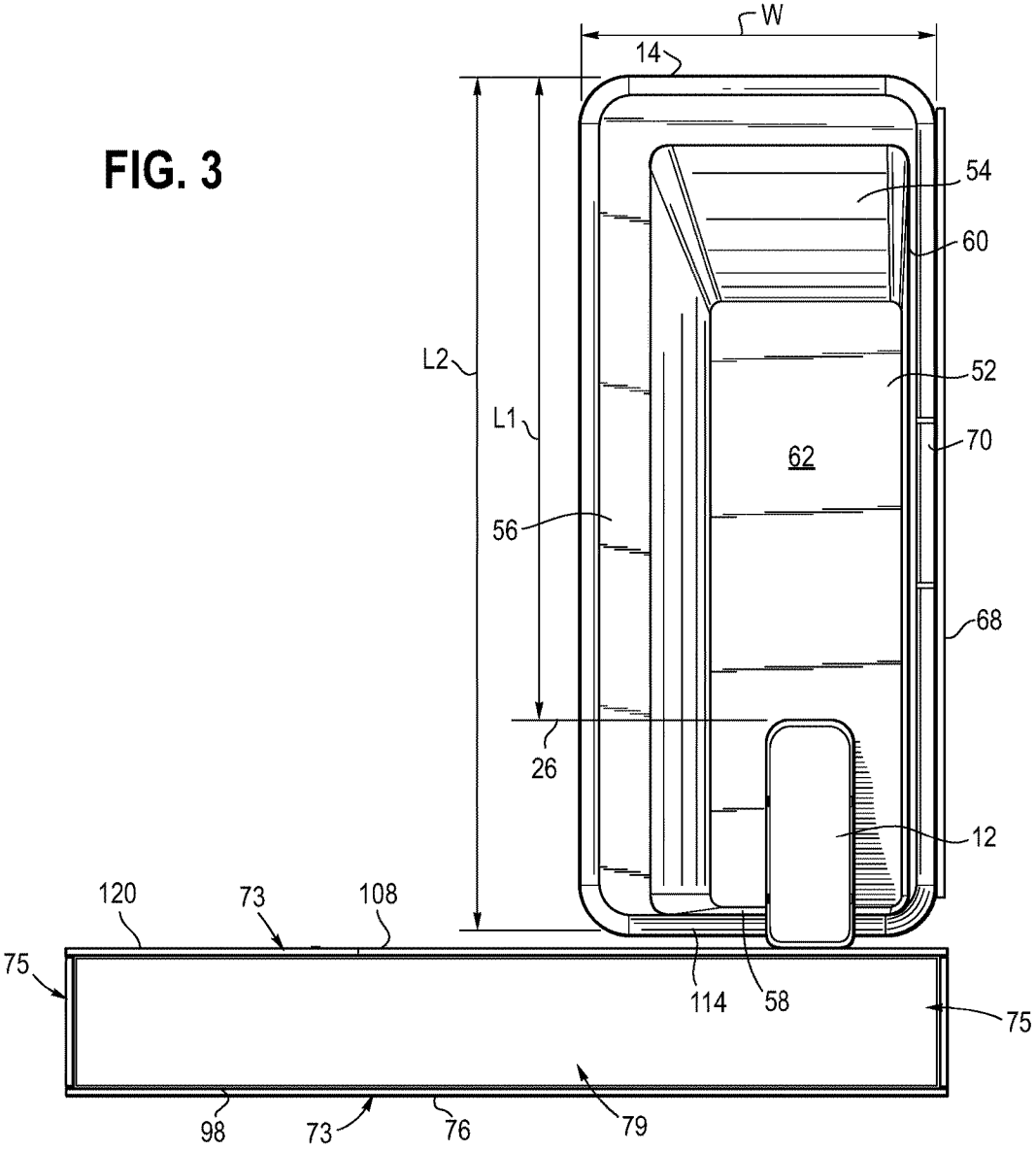
FIG. 3 is a bottom view of the desk shown in FIG. 2A.
Figure 4:
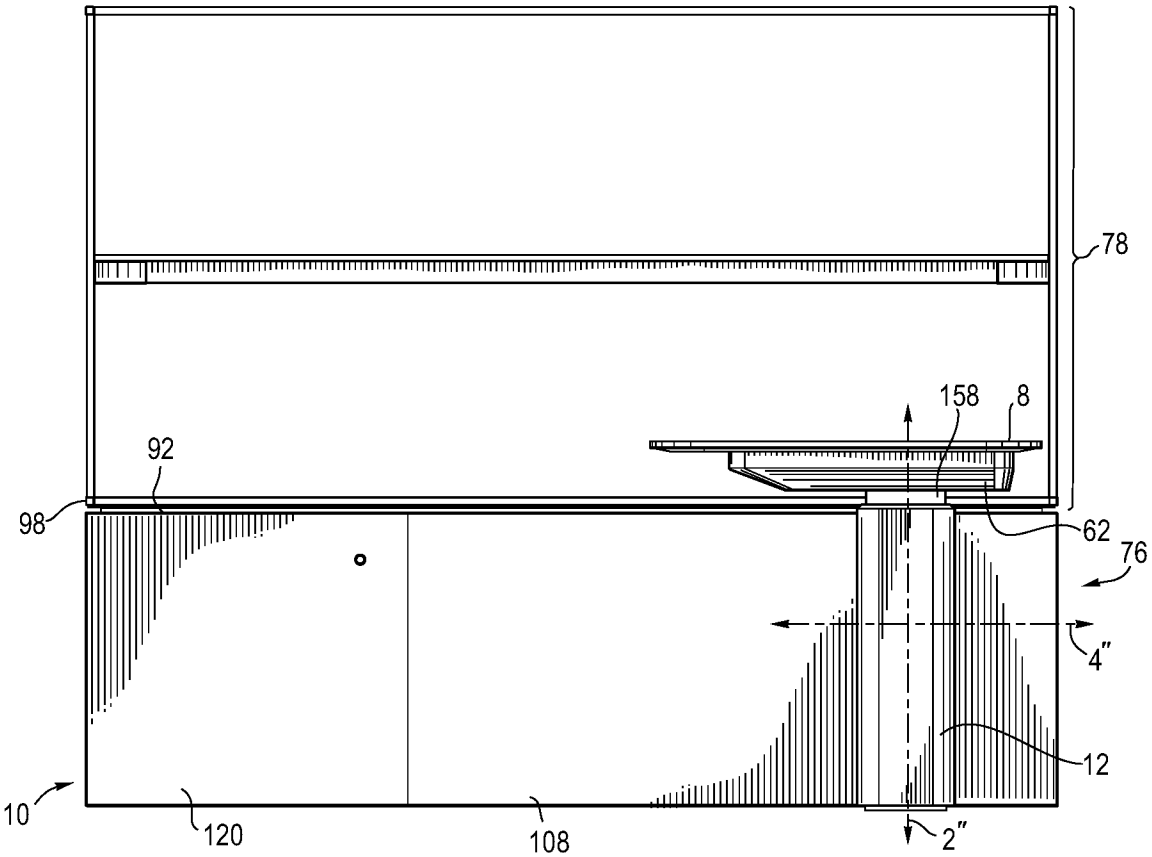
FIG. 4 is a front view of the desk shown in FIG. 2A.
Figure 6:
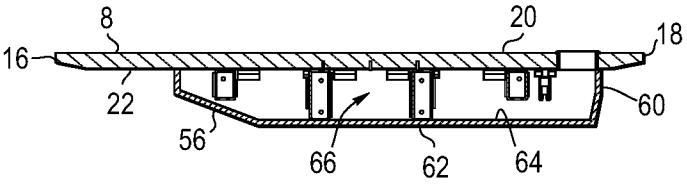
FIG. 6 is a cross-sectional view of the desk taken along line 6-6 of FIG. 5.
Figure 5:
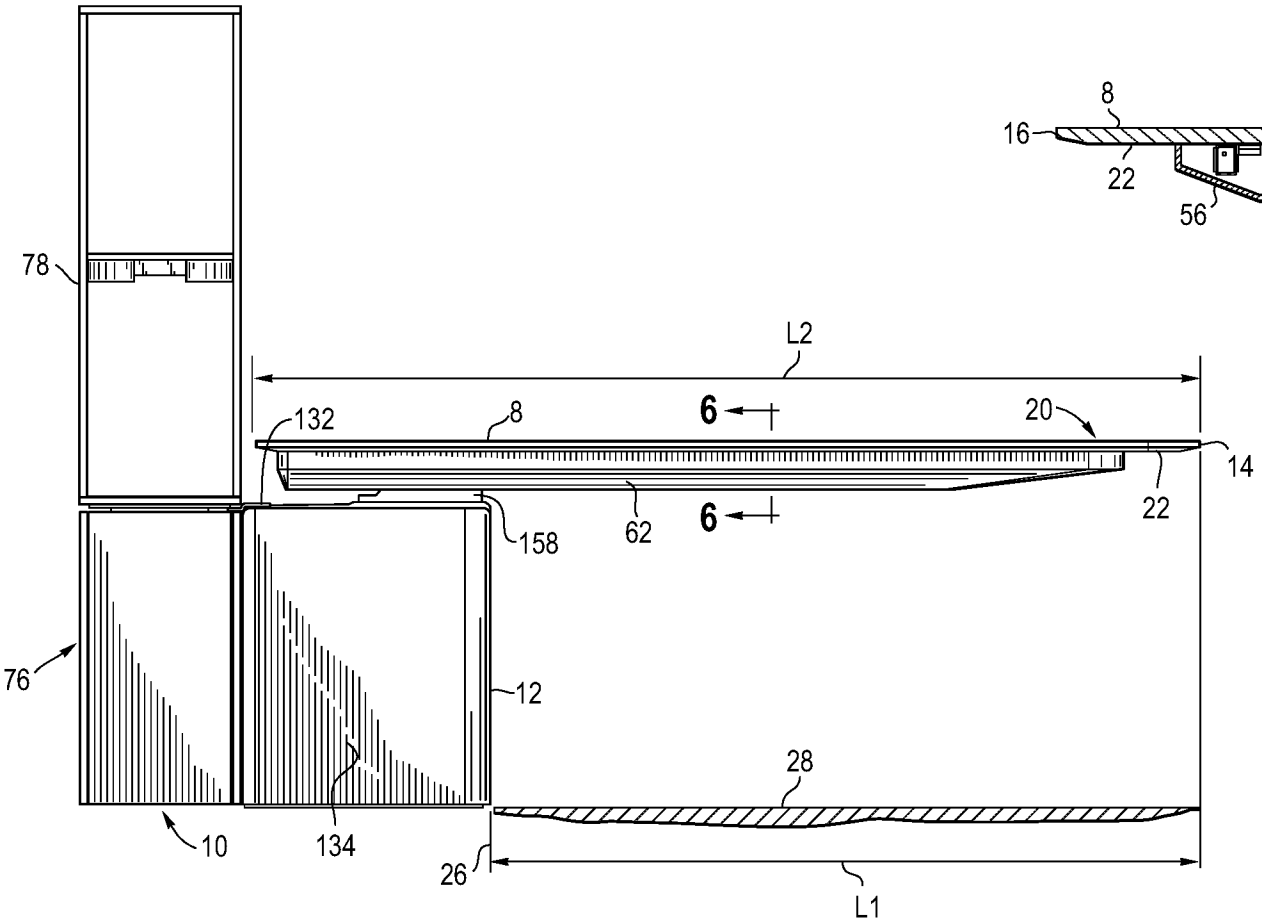
FIG. 5 is a side view of the desk shown in FIG. 2A.

As shown in FIGS. 1, 2A and 3, a screen 68 may be disposed along and spaced apart from the rear edge 18 of the worksurface. The screen may be secured to the understructure 30 and/or worksurface 8 with a mounting bracket 70. A lower modesty portion 72 of the screen extends downwardly from the worksurface, while an upper privacy portion 74 of the screen extends upwardly from the worksurface. In one embodiment, the screen is vertically adjustable relative to the worksurface such that relative proportions of the modesty and privacy portions 72, 74 may be adjusted.

Base:

Referring to FIGS. 1-5, 7-12, 17, 36 and 37, the base 10 includes lower and upper frames 76, 78 extending in the longitudinal direction. The lower frame 76 has opposite sides 73, opposite ends 75, a top 77 and a bottom 79. The lower frame 76 includes upper and lower frame members 80, 82, configured in one embodiment as rails, on each of the sides. The upper and lower frame members are joined with vertically extending frame members 85, which may be configured as web components. The lower frame 76 defines an interior cavity 87 in which counterweights 89 may be positioned to offset any loads transmitted to the cantilevered worksurface. The base may alternatively be fixedly secured to the floor, for example with fasteners, a tether, adhesive and/or combinations thereof. The lower frame 82 is supported on the floor by floor engaging members 91, which may be configured as height adjustable glides, casters or wheels.

The upper and lower frame members 80, 82 each have a plurality of longitudinally spaced openings 84, 84' disposed in upper and lower surfaces 94, 96 thereof respectively. A horizontal web member 86 extends across the upper frame member between side portions thereof, and may be integrally formed therewith, with the side portions having a C-shape. The web 86 has an upper surface disposed below the uppermost surface of the side portions of the upper frame member. In one embodiment, the upper surfaces of the web 86 and side portions of the upper frame member 80 form a cavity 88.

Figure 10:
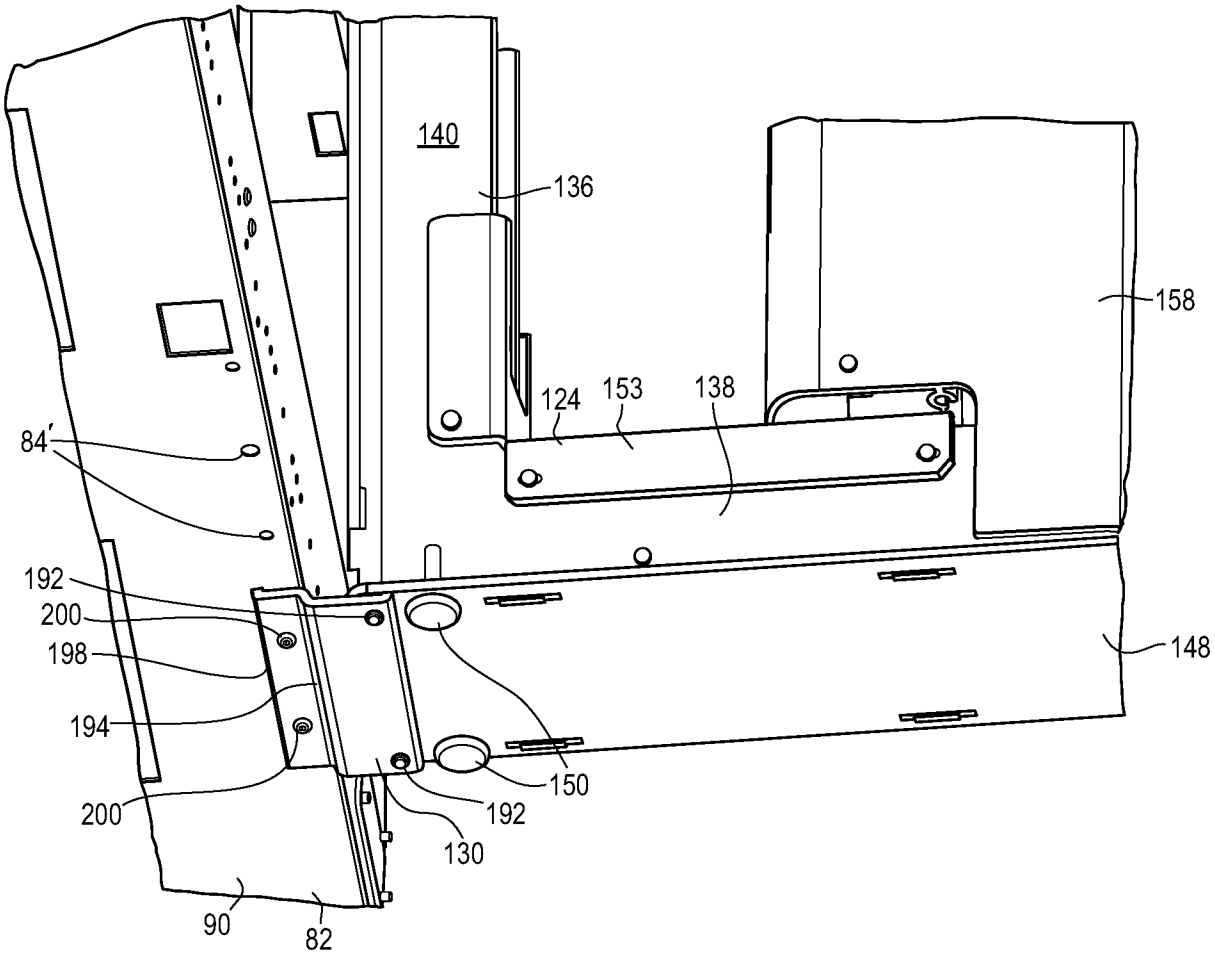
FIG. 10 is an enlarged partial view of a lower connection between the support column assembly and base.
Figure 37:
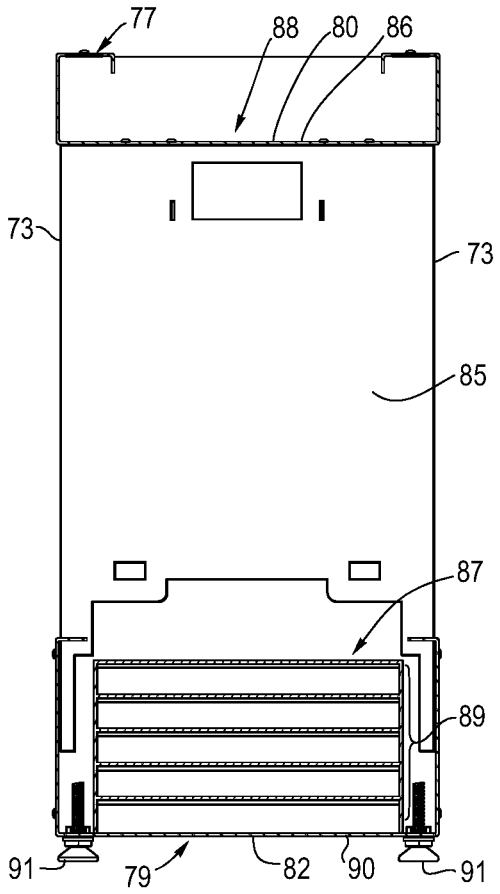
FIG. 37 is a cross-sectional view of the base taken along line 37-37 in FIG. 36.

Likewise, a lower horizontal web 90 extends between side portions of the lower frame member 82, and may be integrally formed therewith as shown in FIGS. 10 and 37. It should be understood that the lower and upper frame members may be integrally formed, with the terms lower and upper referring to the spatial relationship between portions of the structure, and that the term "member" does not require the components to be separately formed, although they may be thus configured, but rather may refer to a portion of larger component. In one embodiment, the frame is made of metal, for example steel sheet metal components.

Figure 7:
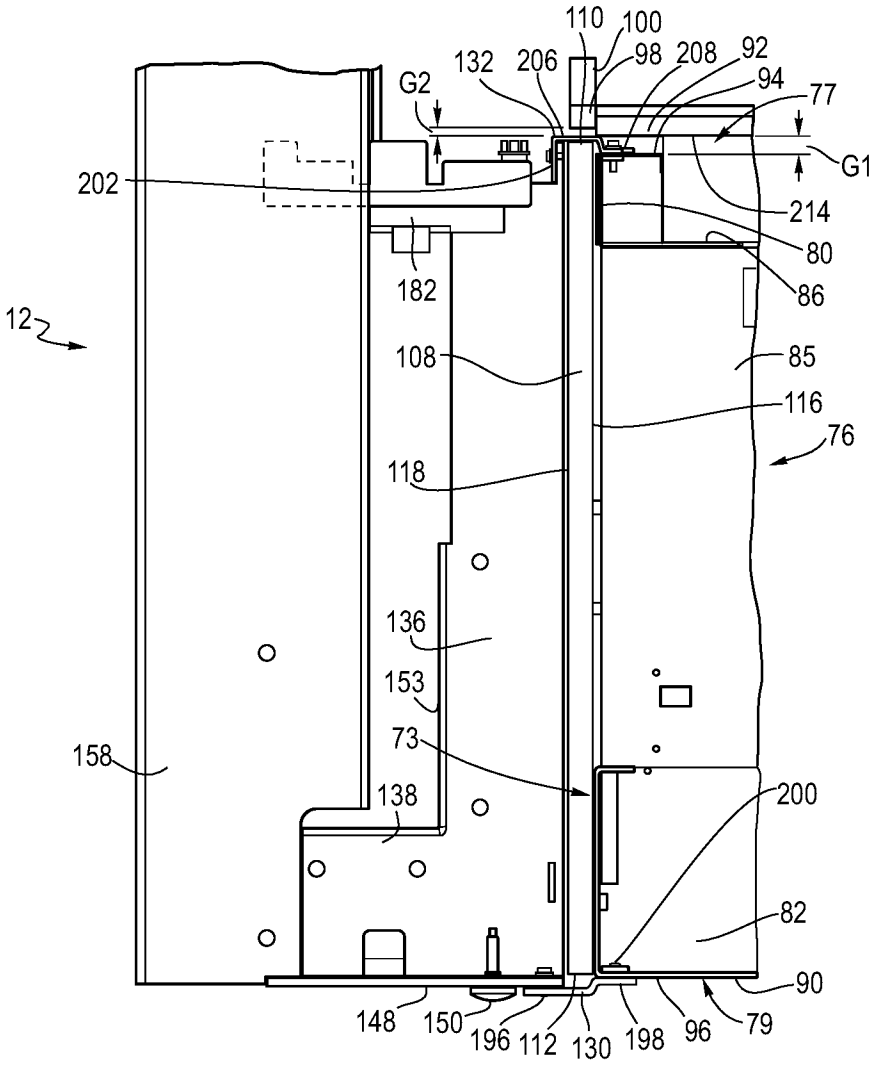
FIG. 7 is a partial side view of a support column assembly coupled to a base.

A top 92 is secured to the top 77 of the lower frame 76 and has a bottom surface 214 spaced above the upper surface of the upper frame members to thereby form a gap G1 as shown in FIG. 7. The sides are substantially parallel to the sides of the upper frame members. An upper frame 78 includes lower and upper horizontal rectangular frame members 98 joined at opposite ends thereof to four vertical frame members 100 defining an open structure. One or more shelf supports 102 are coupled to the vertical frame members at intermediate locations between the upper and lower horizontal frame members. One or more shelves 104 may be secured to the shelf supports to provide storage space. Side walls 106 may also be secured to the frame members to define various storage cavities, and may have different heights, including walls that extend a full or half length. The lower horizontal frame member 98 of the upper frame 78 is positioned outboard of the top 92 and is abutted against the side edge thereof.

Side skins 108 each have top and bottom edges 110, 112, opposite ends 114 and inner and outer sides 116, 118. The inner side 116 of each skin is secured to one of the outwardly facing sides of the frame, and in particular to the sides of the upper and lower frame members on that side. Referring to FIGS. 36A-D, the skins have a plurality of upper brackets 117 spaced apart along the top of the inner side of the skin. Each bracket has a pair of laterally extending flanges 119 that overlie the upper frame and are secured to the upper surface 94 thereof with fasteners 121. The skins 108 also include one or more intermediate brackets, including a pair of intermediate brackets 123 secured to the inner side 116 adjacent the opposite ends 114. The intermediate brackets 123 include one or more laterally extending hooks 125 (shown as a pair) that are inserted into slots 127 in the lower frame, and in particular slots 127 formed in the end members 75 and/or frame members 85. The skins also include a plurality of lower brackets 129 spaced apart along the bottom of the inner side of the skin. Each bracket 129 has a pair of laterally extending hooks 131 (shown as a pair) that are inserted into slots 133 formed in the lower frame 82. The brackets 117, 123, 129 may be secured to the skins with fasteners, adhesive, welding and/or combinations thereof, depending on the material of the skins. The skins may be made of a rigid or flexible material, including for example, laminate (including whiteboard), veneer, Corian, glass, fiberboard, wood, whiteboard, or combinations thereof, and may include an outer fabric layer. The top edge 110 of the skin is spaced below the bottom surface of the lower horizontal frame member 98 of the upper frame to form a gap G2 as shown in FIG. 7. The skins may be continuous and have a length running substantially the length of the base. Alternatively, the skin may run a portion of the length, with a door or drawer 120 coupled to the frame along the remaining length thereof. End skins 122 may also be secured to the ends of the base, and in particular the frame.

Figure 8:
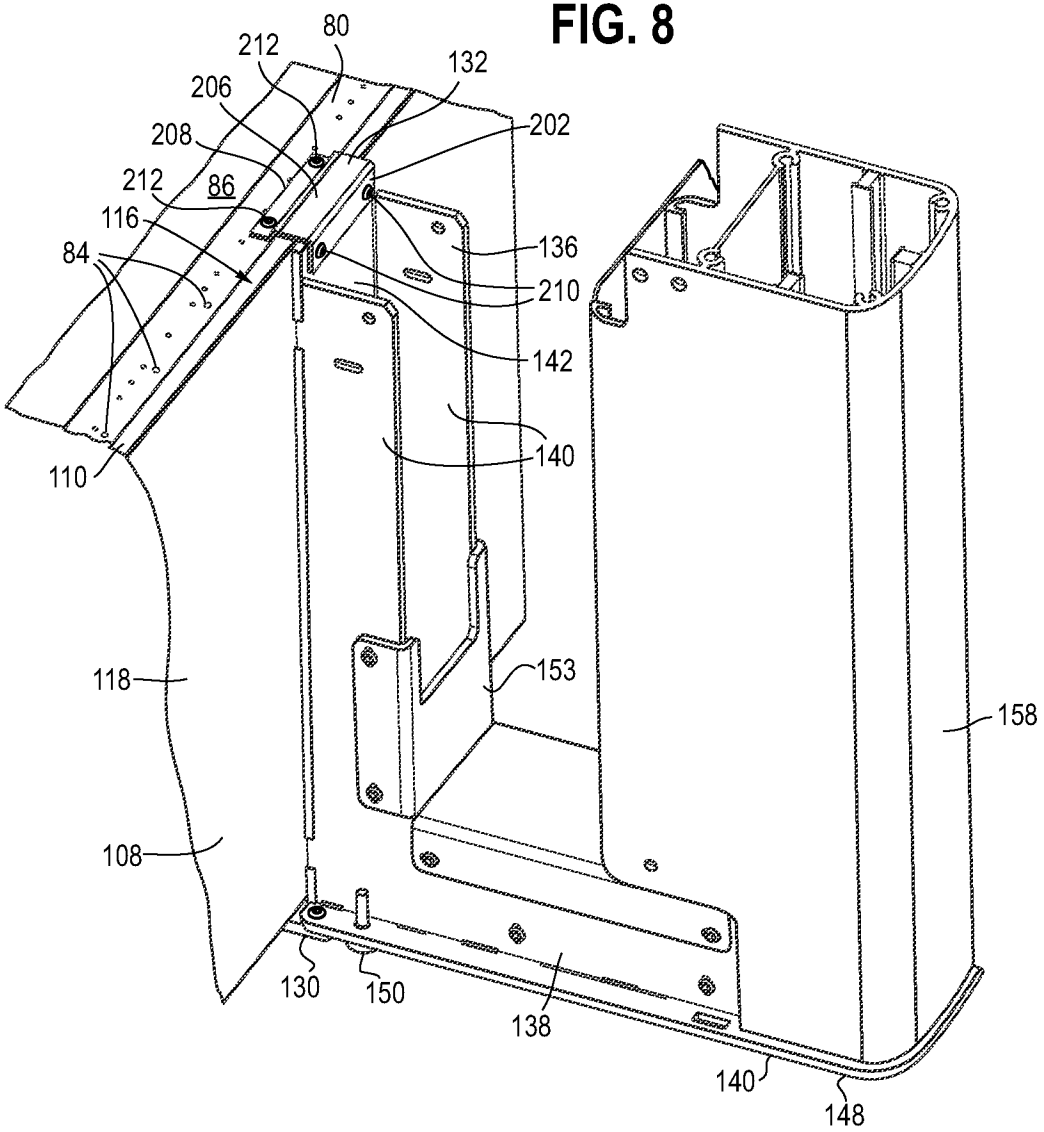
FIG. 8 is a top perspective view of a support column assembly coupled to a base.
Figure 9:
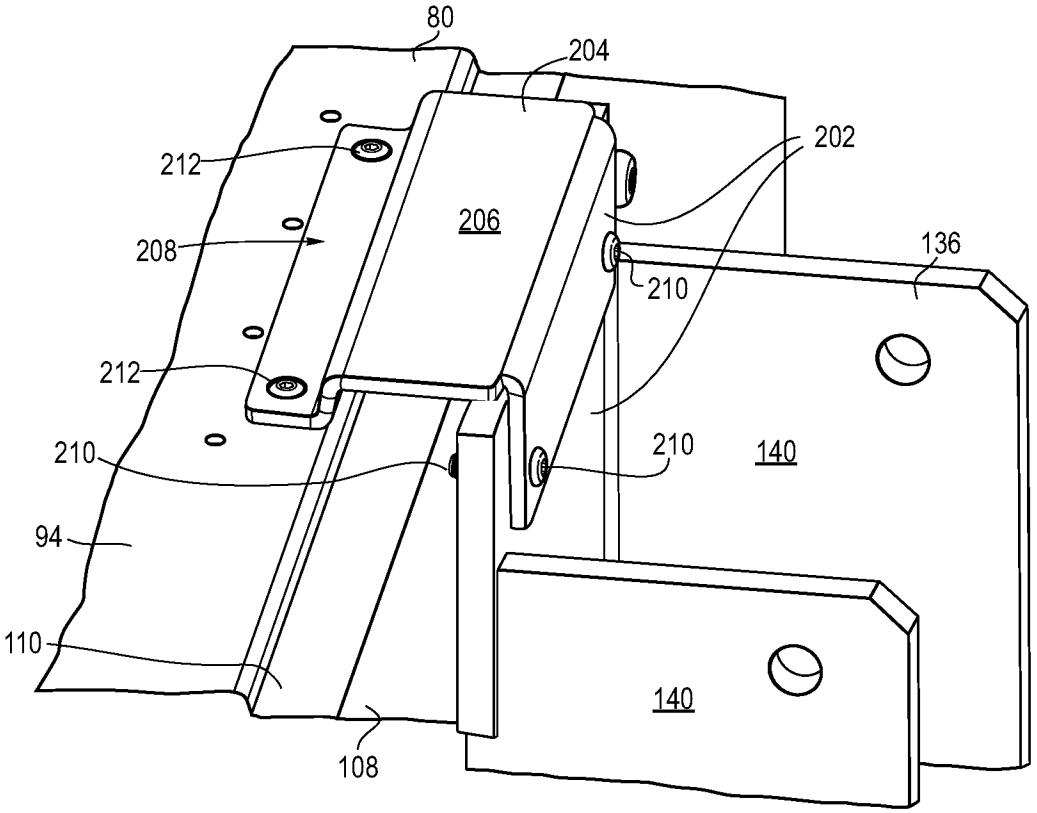
FIG. 9 is an enlarged partial view of an upper connection between the support column assembly and base.

Height Adjustable Support Column Assembly:

Referring to FIGS. 7-10 and 15A-16, the height adjustable support column assembly 12 includes a brace 124, a height adjustable support column 126, a linear actuator 128, lower and upper mounting members 130, 132 and a shroud 134. In one embodiment, the brace has an L-shape, including a vertical member/portion 136 spaced apart from the outer surface 118 of the skin 108 and a horizontal member/portion 138 extending outwardly from a bottom of the vertical member. The brace member is made of steel in one embodiment. The horizontal and vertical members/portions may be integrally formed, or configured as separate components that are thereafter connected with fasteners, welding and the like. The vertical member has three sides in one embodiment, including a pair of side walls 140 and a vertical end wall 142, while the horizontal member 138 has a pair of side walls 144 integral with, or overlapping, the side walls 140 of the vertical member. The horizontal member is secured to a floor or support platform 148, with four floor interface members 150 threadably engaging the support platform and resting on the floor. The floor interface members, shown as glides, may be rotated so as to independently adjust the vertical height of the platform at each location, thereby allowing the brace 124 and height adjustable support column assembly 12 to be leveled. An L-shaped bracket 153 may be secured to the vertical and horizontal portions, closing a portion of the open fourth side of each of those portions as shown in FIG. 8

Referring to FIGS. 13 and 15A-16, the support column 126 includes a vertically upright inner member 152 coupled to the horizontal member 138 of the brace, and/or to the platform, and extending upwardly therefrom at a spaced apart location from the vertical member 136 of the brace, forming a gap G3 therebetween. In one embodiment, the inner member 152 is configured as a square tube, for example steel or another suitable metal, which may be extruded. The inner member has three sets of four rollers arranged on three sides of the tube, with each set having an upper and lower pair of rollers 154, 156. In one embodiment, the inner member is fixed to the brace and is not movable in a vertical direction.

A vertically upright outer member 158 defines an outer tube 160 having three T-shaped ribs 162 extending inwardly into a first cavity defined by the outer tube, with the ribs running along a length thereof. The T-shaped ribs define tracks that are disposed between the rollers 154, 156 of each of the upper and lower pairs on the three sides of the inner member tube, which provide for a smooth telescoping movement between the moveable outer member and the fixed inner member. In addition, the outer member has four C-shaped boss structures 164 in the four corners of the tube. The boss structures may be threadably engaged by the fasteners 46, 47 extending from the understructure attachment plate 40, as discussed previously. The outer tube 160 surrounds the inner tube 152. The outer tube 160, with its various ribs 162 and boss structures 164 may be formed as an extrusion, for example of metal such as steel or aluminum. The outer member 158 and tube 160 move telescopically and vertically up and down relative to the inner tube 152 while being guided by the rollers 154, 156. The outer member 158 includes side walls 168 that extend past the fourth wall of the outer tube 160 thereof and defines a second cavity. The ends 170 of the side walls 168 are curved inwardly, and include grooves 171 that may interface with a cover 180 extending between the ends 170. A support plate 174 is secured across the top of the cavity 172 between the walls 168 and the fourth wall of the tube 160.

Figure 15B:
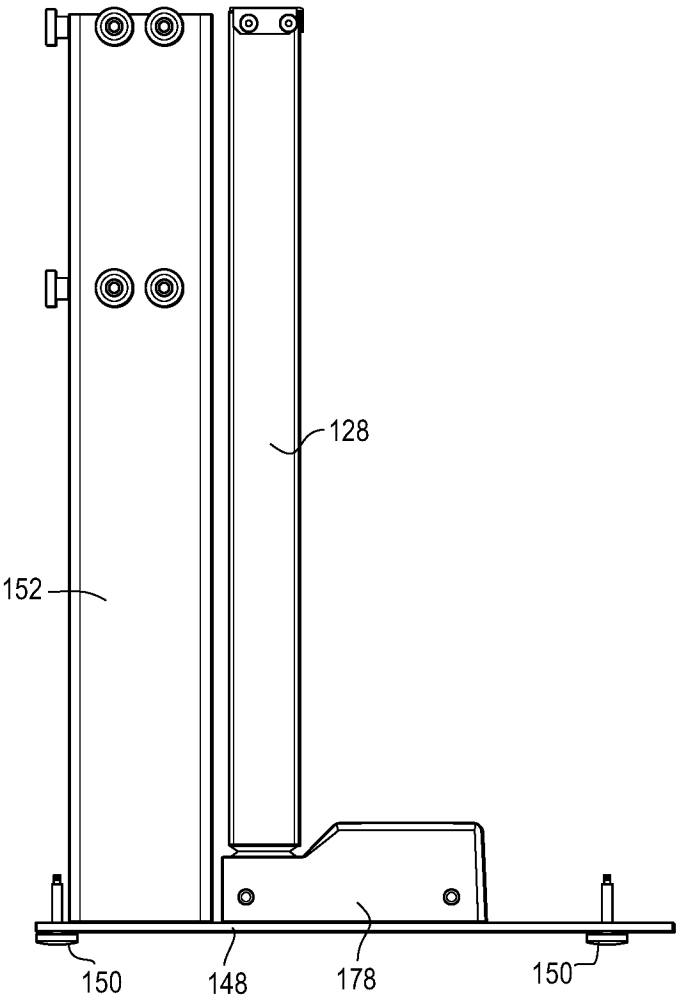
FIG. 15B is a partial side view of the support column assembly shown in FIG. 15A.
Figure 15A:
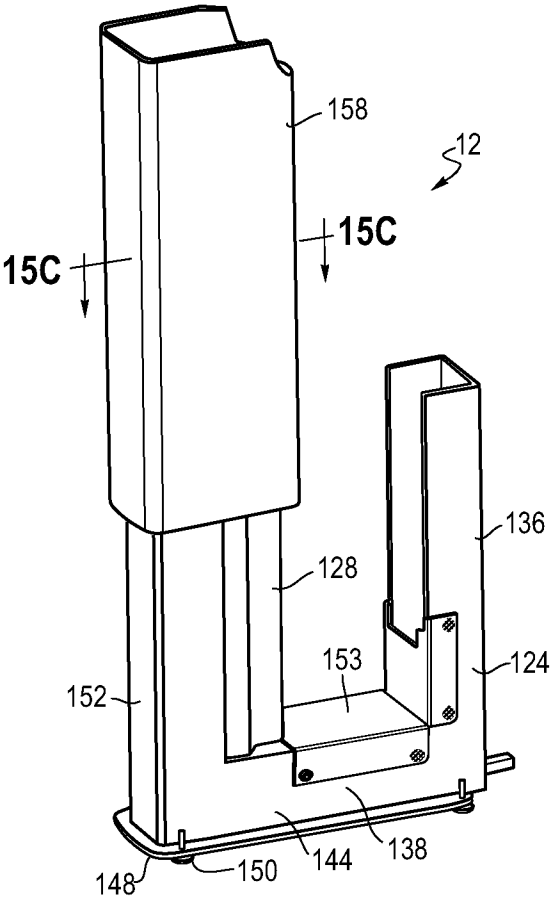
FIG. 15A is a front perspective view of a support column assembly with a height adjustable support column in an extended position.
Figure 15C:
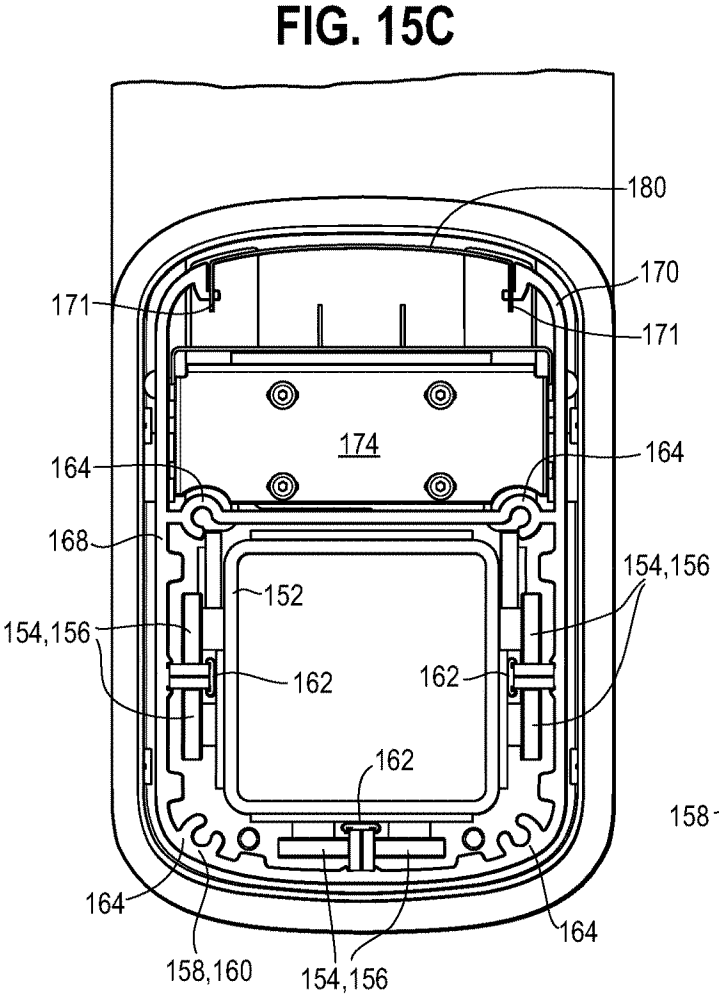
FIG. 15C is a cross-sectional view of the support column assembly taken along line 15C-15C of FIG. 15A.

Referring to FIG. 15B, the linear actuator 128 has a bottom motor 176 mounted to the support platform 148 and/or horizontal member 138 of the brace and a top 178 coupled to the support plate 174 and outer member 158. Alternatively, sides of linear actuator motor 176 are coupled to the side walls 144 of the horizontal member 138. The actuator may be extended and contracted to telescopically move the outer member 158 relative to the inner member 152 to define different overall lengths of the support column 126, and corresponding or associated heights of the work-surface. The linear actuator may be pneumatic, electric and/or hydraulic. One suitable actuator is the DL1A electric actuator available from LINAK.

Figure 11:
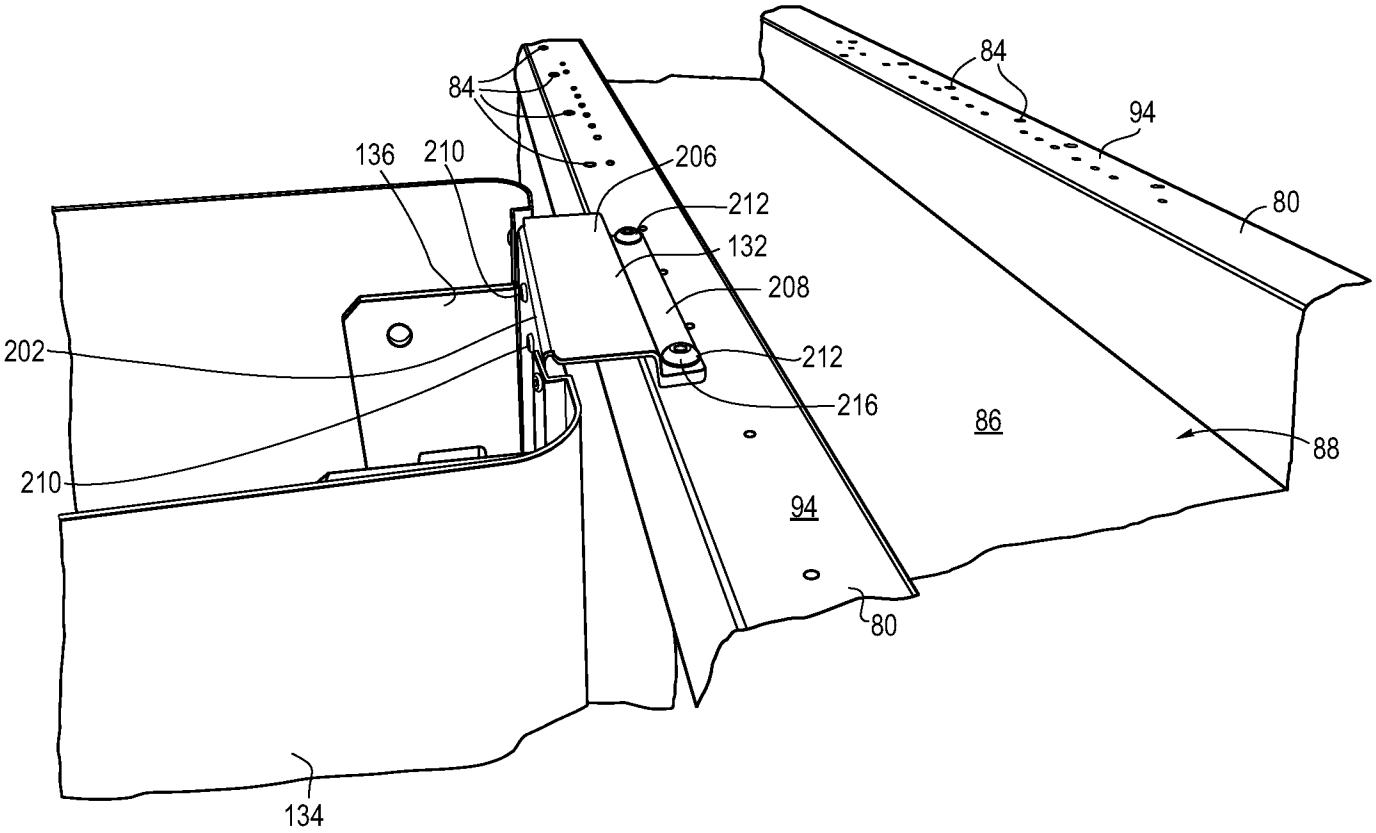
FIG. 11 is an enlarged partial view of the upper connection between the support column assembly and base configured with a shroud.
Figure 12:
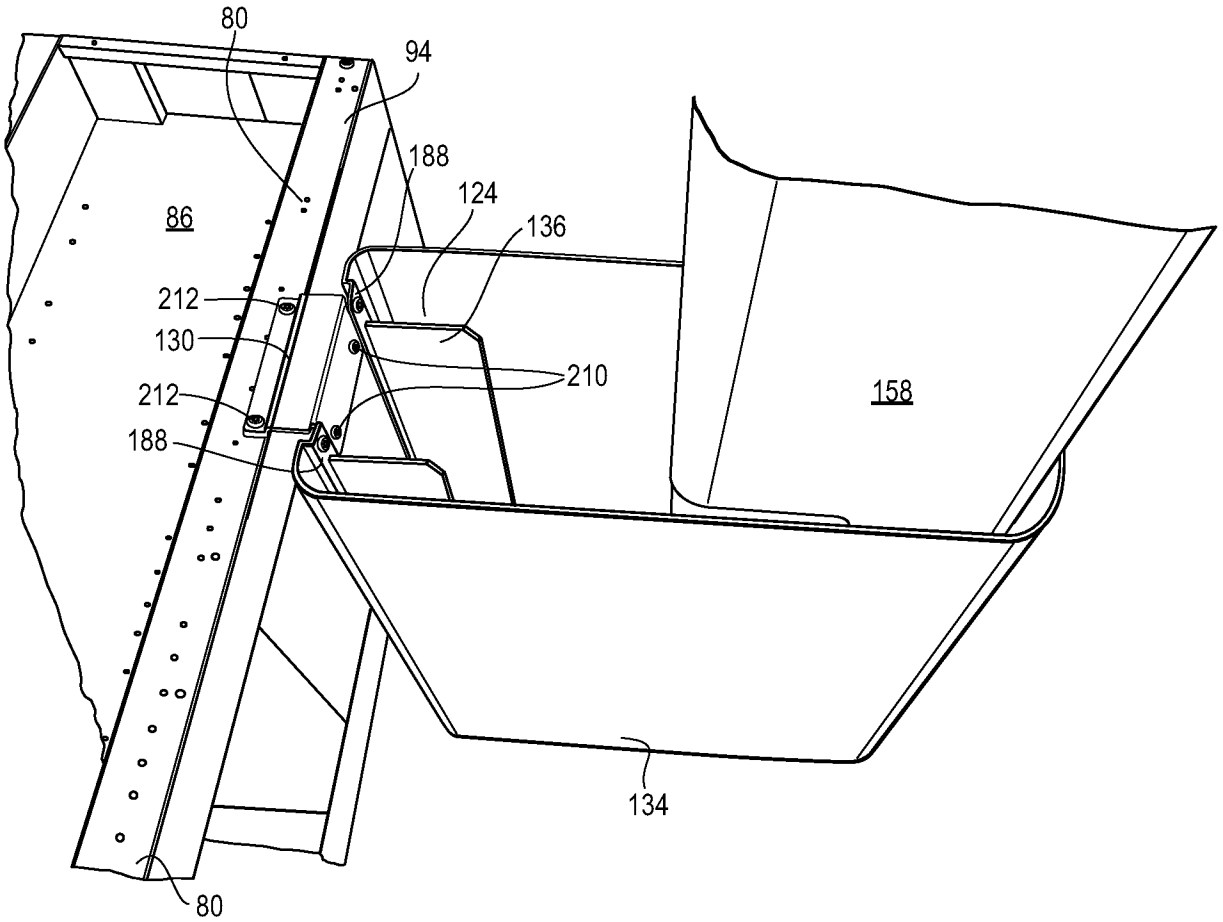
FIG. 12 is a perspective view of a base and support column assembly having a height adjustable support column in an extended position.
Figure 13:
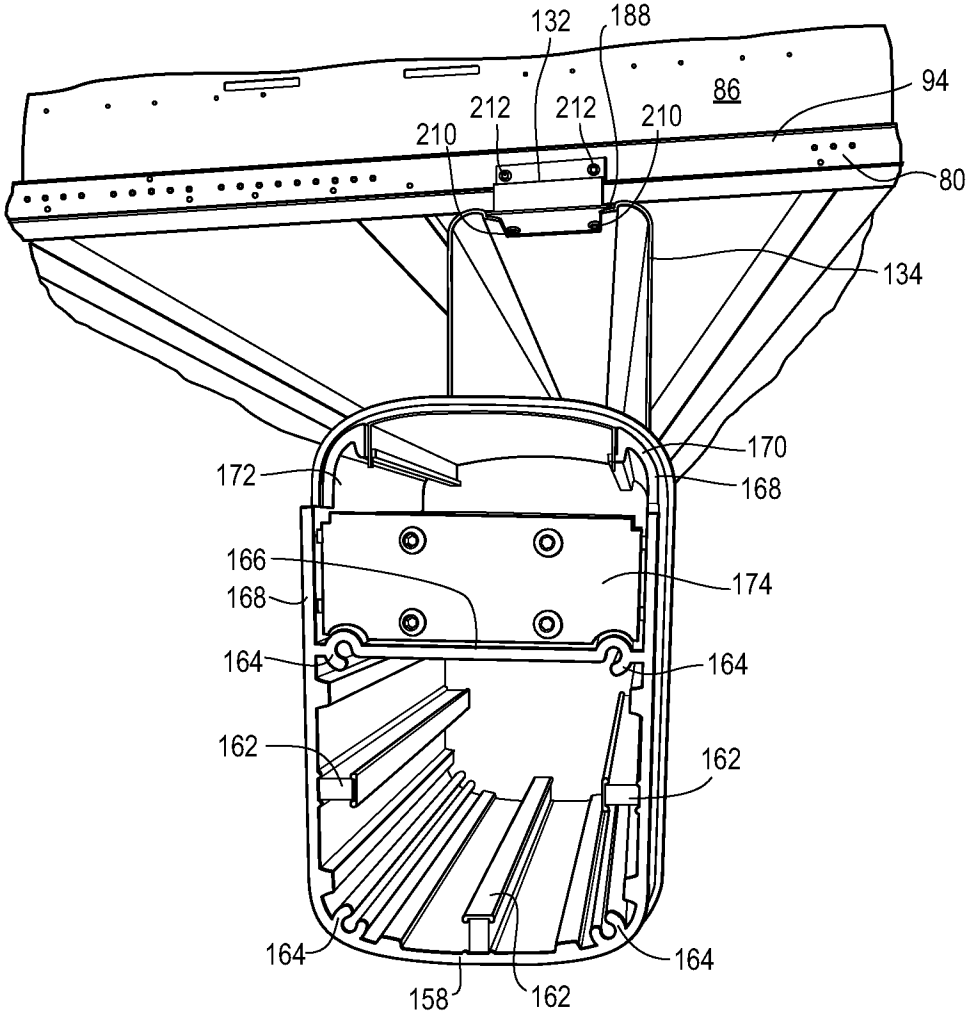
FIG. 13 is a top view of the assembly shown in FIG. 12.
Figure 15D:
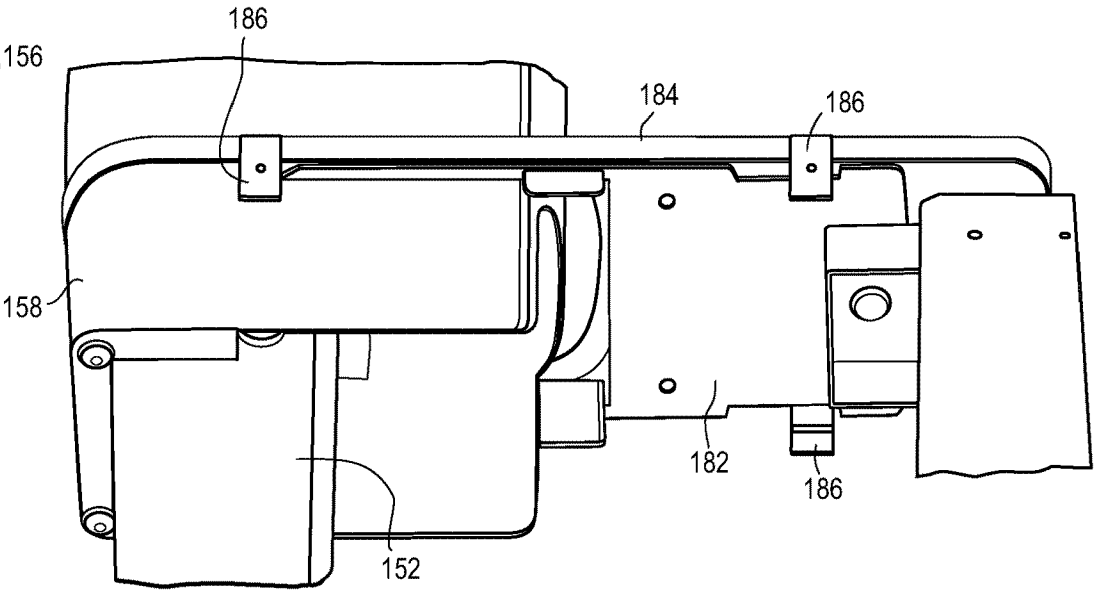
FIG. 15D is a partial perspective view of an upper portion of the support column assembly shown in FIG. 15A.
Figure 17:
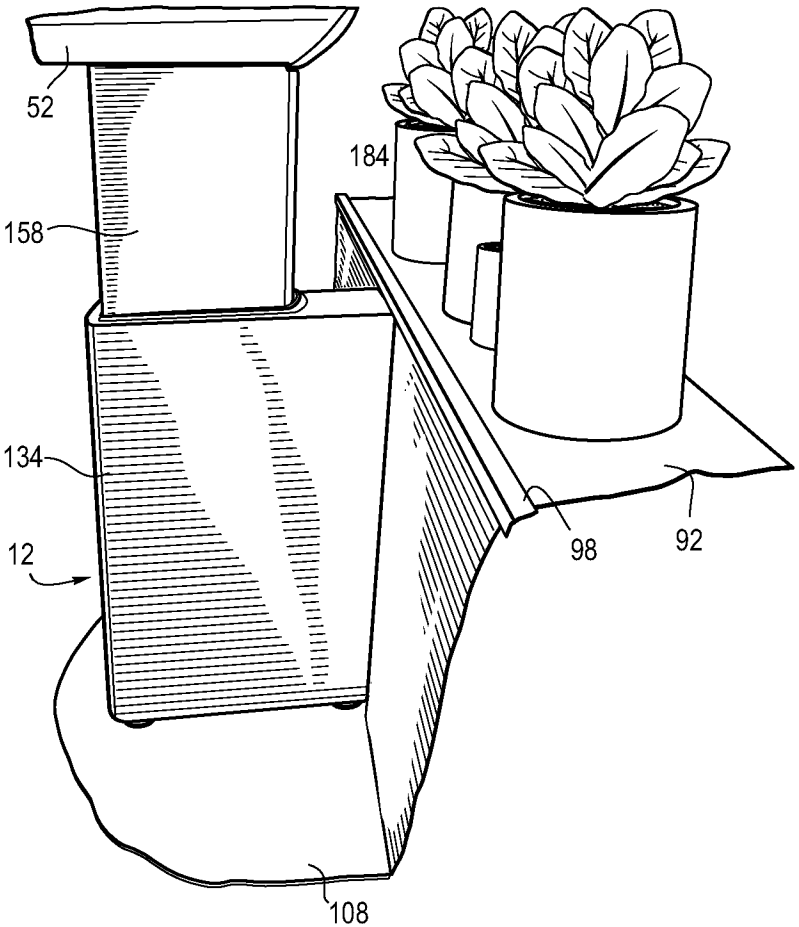
FIG. 17 is a partial perspective view of a desk.
Figure 16:
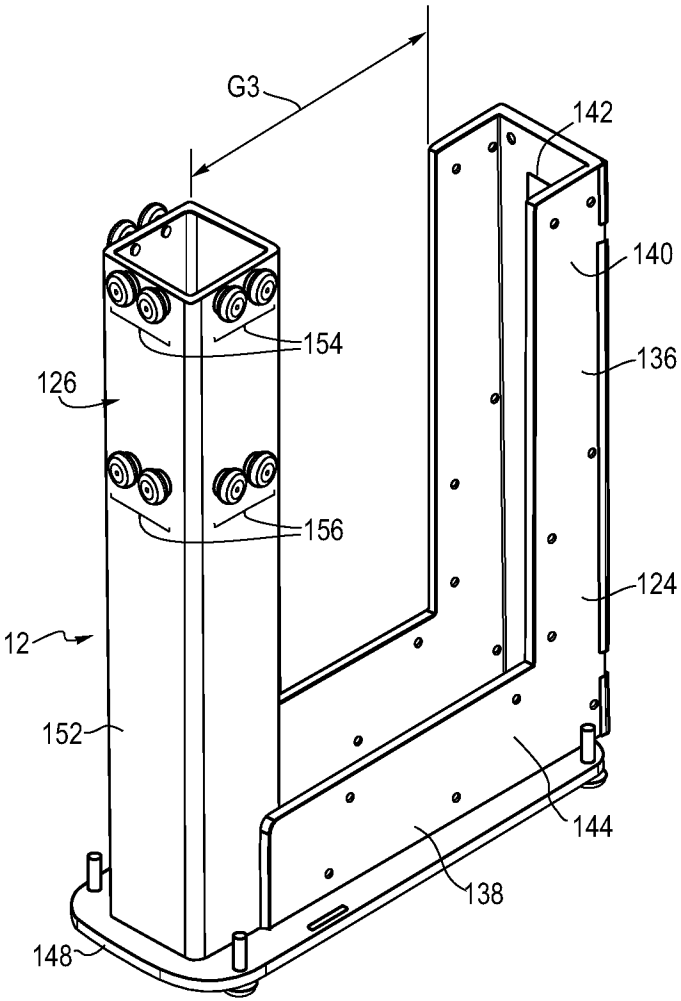
FIG. 16 is a partial perspective view of a support column structure.

Referring to FIG. 15D, a bracket 182 is coupled to the top of the vertical portion of the shroud 134 and extends outwardly in an overlying relationship with the platform. A cap 184 is secured to the bracket. The cap has an opening through which the outer member 158 moves vertically, with the curved edges 170 and cover 180 giving the appearance that the outer member is a curved tubular member, since the space between the curved edges faces the base and is not readily visible to a user. Clips 186 secure the cap to the bracket 182. The shroud 134 encircles the brace 124 and support column 126 and is secured to the platform 148 and bracket 182 with clips and/or brackets. Alternatively, the shroud has three sides, and a pair of spaced apart tabs 188 on a fourth side as shown in FIGS. 11 and 12. The tabs are coupled to the end wall of the vertical brace member with fasteners.

The lower mounting member 130 is coupled to the platform and horizontal brace member with a pair of fasteners 192, welding or combinations thereof. The lower mounting member includes a stepped flange 194 having a first portion 196 extending under, or underlying, the bottom edge 112 of the skin and a second portion 198 extending laterally and spaced vertically upwardly from the first portion, with the second portion underlying the lower surface 96 of the lower frame member 82. The second portion includes a pair of fastener openings that are spaced to align with a pair of fastener openings formed in the lower frame member, with fasteners 200 releasably securing the lower mounting member 130 to the lower frame member 82. The lower mounting member may be made of metal, such as steel.

The upper mounting member 132 has a vertical flange 202 disposed interiorly of and coupled to the end wall 142 of the vertical member of the brace with a pair of fasteners 210, welding or combinations thereof. A horizontal stepped flange 204 extends from the vertical flange 202 away from the brace toward the base 10. The stepped flange includes a first portion 206, which extends through the gap G2, overlies the top edge 110 of the skin, and underlies the bottom surface of the frame member 98 forming part of the upper frame 78. A second portion 208 extends laterally from the first portion into the gap G1, with the bottom surface 214 of the top 92 disposed above and overlying the second portion 208, which overlies the upper surface 94 of the upper frame member 80. The second portion 208 is spaced vertically downwardly from the first portion 206, being connected with a vertical transition portion. The second portion 208 includes a pair of fastener openings 216 that are spaced to align with a pair of fastener openings formed in the upper frame member 80, with the second portion 208 being coupled to the upper frame member 80 with fasteners 212. The top edge 110 of the skin is vertically spaced above the upper surface of the upper frame member. The upper mounting member may be made of metal, such as steel.

The upper and lower mounting members 132, 130 may be releasably coupled to the upper and lower frame members 80, 82 at any combination of openings formed therein, thereby providing for repositioning of the support column assembly 12 and worksurface 8 at various locations along the length of the base 10, without having to remove or adjust the positioning or length of the skin 108. In a disengaged configuration, wherein the fasteners 200, 212 are removed, the height adjustable support column assembly 12 is moveable relative to the base 10 and skin 108 in the longitudinal direction 2. The fasteners 200, 212 may then be installed to couple the height adjustable support column to the frame in an engaged configuration. In other embodiments, the mounting members may be releasably coupled to the frame members with clamps, spring loaded pins, or other attachment components at any location along the length of the frame members, meaning the adjustment is infinite. In one embodiment, the upper and lower frame members are simply provided with elongated slots, rather than spaced apart discrete fastener openings, such that the height adjustable support column may be infinitely adjusted and moved to any position along the length of the base and thereafter secured with fasteners engaging the elongated slots.

The assembly of the desk ensures that the height adjustable support column assembly may not become inadvertently dislodged from the base. In particular, the top 92 is secured to the base 10 after the upper mounting member 132 is secured to the upper frame member 80. The mounting member cannot be inserted through the gaps G1 and G2, or screwed to the upper frame member, if the top is installed. As such, once the top is installed, it prevents the upper mounting member from being dislodged, or removed through the gaps G1 and G2. At the same time, due to the hidden connection, and ability to install the support column assembly with disturbing or altering the skin, the base may also be used in a stand-alone configuration without any worksurface coupled thereto.

Power Grommet:

Referring to FIGS. 1, 18-35 and 41-44, the worksurface has an elongated opening 220 formed therein. In one embodiment, the opening has an obround shape, with parallel sides 222 and curved, semi-circular ends 224. An obround power grommet 230 is disposed in the obround opening. It should be understood that other shapes, including various polygonal, circular, elliptical shapes, etc. of the opening and/or of the power grommet, may also be suitable to provide the functional aspects of a power grommet, while the shape illustrated herein is selected to provide a particular ornamental/aesthetic appearance of an obround power grommet that may have different lengths in different embodiments. The power grommet has a housing 232 including a side wall 234 and an upper lip 236 extending radially outwardly from an upper end of the side wall. The side wall has parallel side portions and curved end portions that match, and are inserted through, the elongated opening 220 in the worksurface. The side wall has a height that is dimensioned to extend through at least the thickness of the worksurface. The housing defines an elongated cavity 238, which is open along a top 240 of the housing. The upper lip 236 engages the top or upper surface 20 of the worksurface. In one embodiment, the housing is made of die-cast aluminum.

A first outlet block 242 is inserted into the cavity 238 of the housing along one end thereof. The outlet block has a base. A mounting bracket 244 is coupled to the housing and includes a flange 246 extending outwardly from the outer surface of the housing. The mounting flange may be secured to the bottom surface 22 of the worksurface, for example with one or more fasteners. In an embodiment shown in FIG. 19B, a pair of U-shaped mounting brackets 344 surround opposite ends of the housing and have a pair of arms 356 with tabs 346 that engage slots 350 formed in the housing. Each mounting bracket also includes an insert member 348 inserted into a slot 352 formed in the end of the housing. The bracket 344 includes a mounting flange 358 with a hole 360 that receives a fastener 362 that engages a bottom of the worksurface.

The outlet block is secured to the housing. The block includes an insert member 243, or tab, which engages a slot 245 formed in the end of the housing. The slot allows for the block to slide into the housing, with one or more screws 247 then secured through the side.

Figure 18:
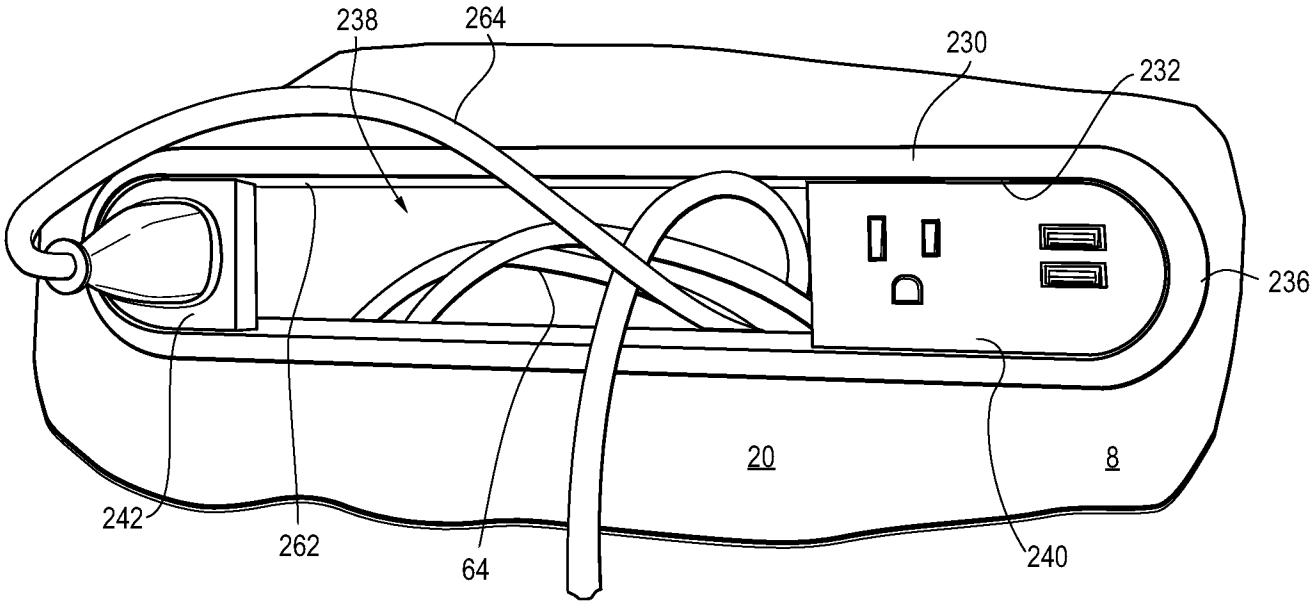
FIG. 18 is a partial top view of a worksurface with a power grommet arranged therein.
Figure 19A:
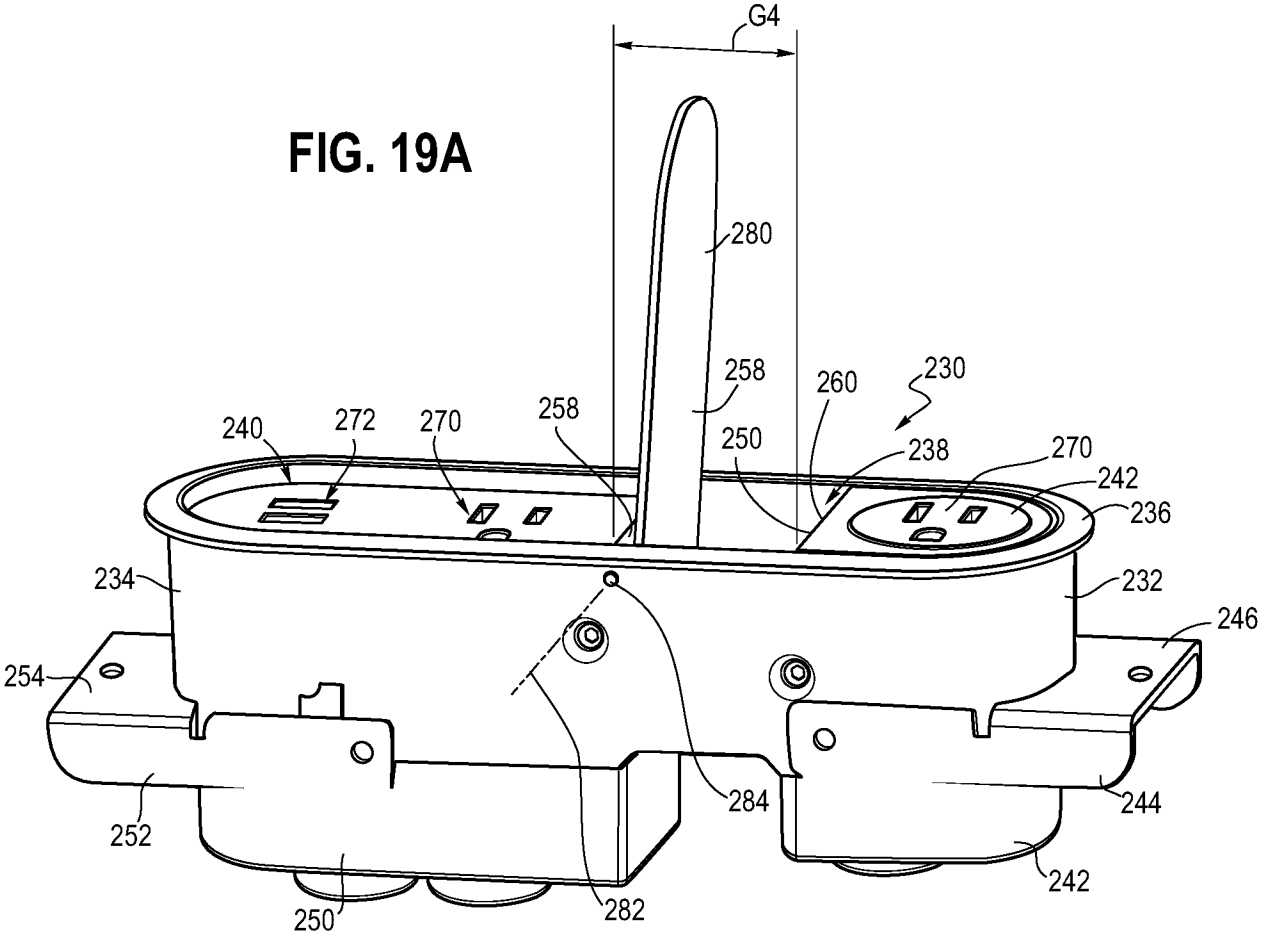
FIGS. 19A and B are perspective views of alternative embodiments of a power grommet.
Figure 19B:
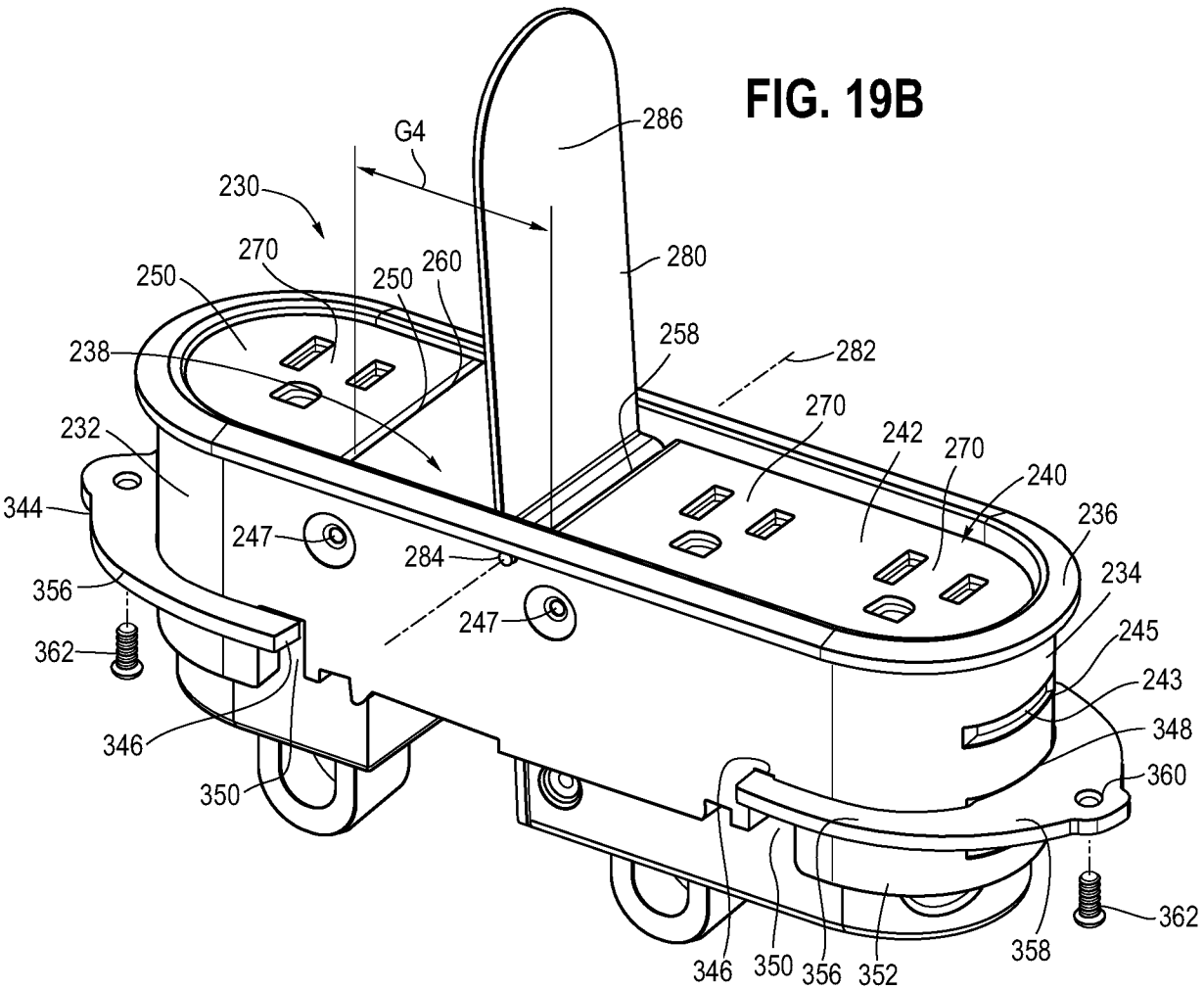
Figure 20:
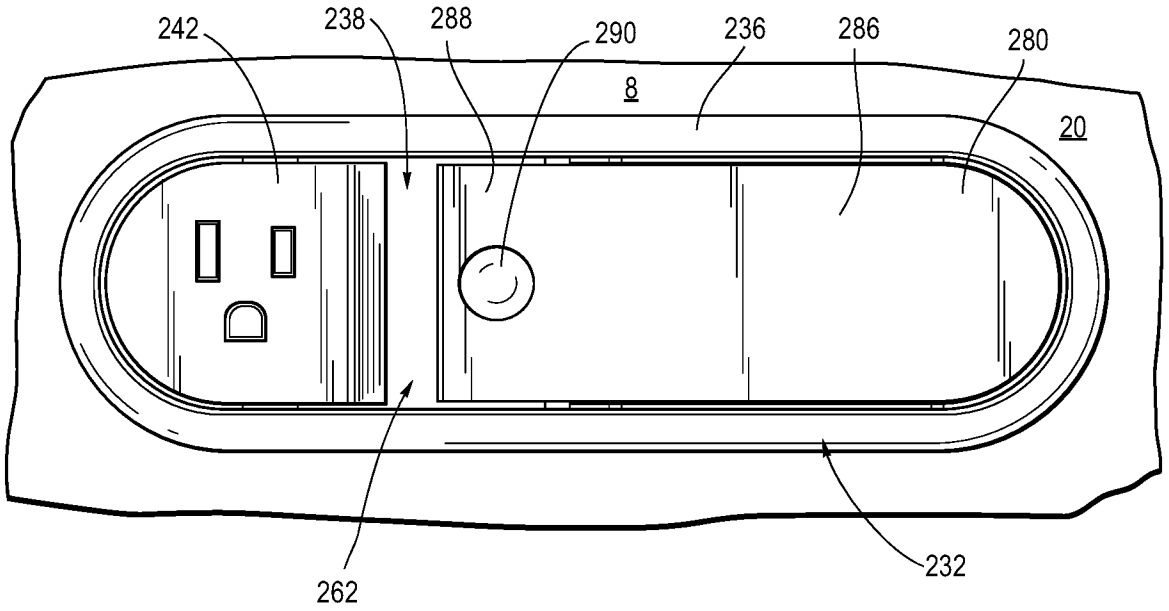
FIG. 20 shows a slightly front-rotated top view of a power grommet mounted in a simulated woodgrain worksurface.
Figure 21:
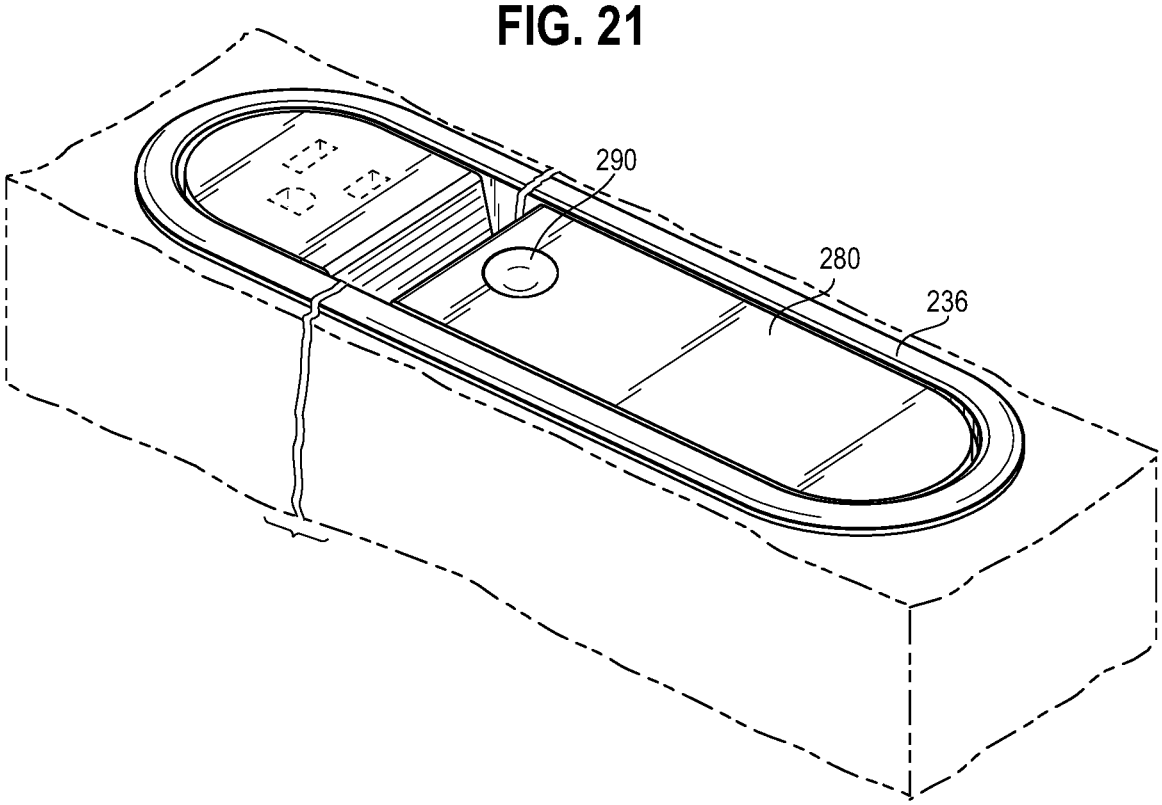
FIGS. 21-25 show, respectively top perspective view, top plan view, end elevation views, and side elevation view of a power grommet with a closed lid, illustrated with a generic potential worksurface environment that highlights an ornamental appearance of the power grommet.
Figure 22:
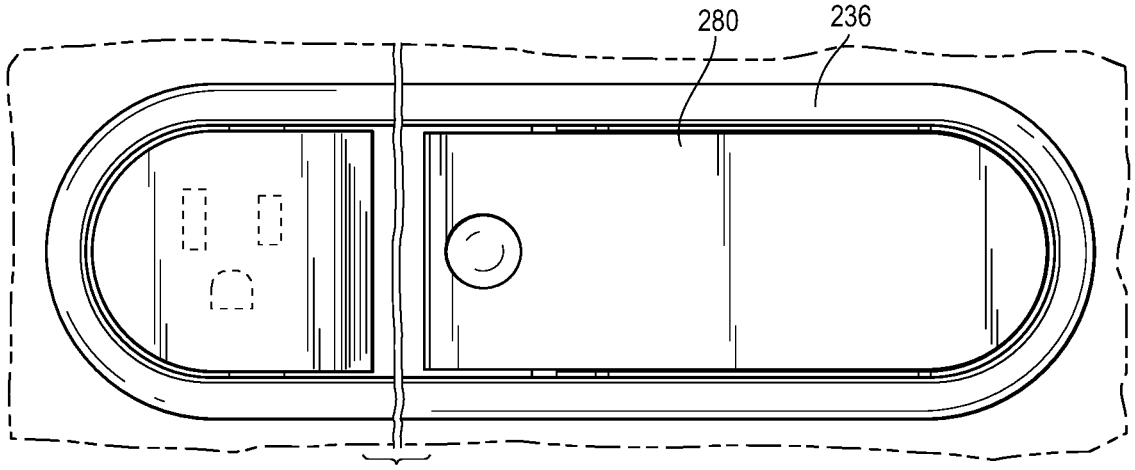
Figure 23:
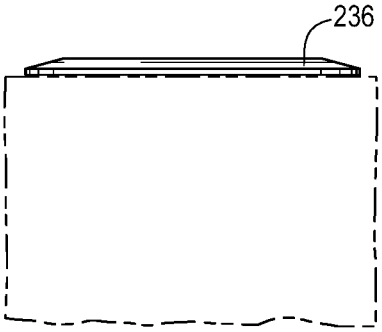
Figure 24:
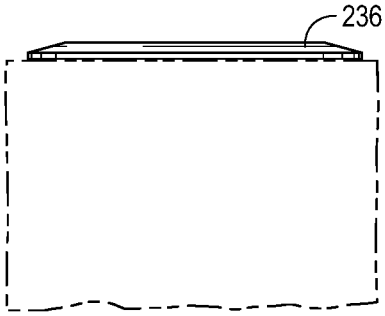
Figure 25:
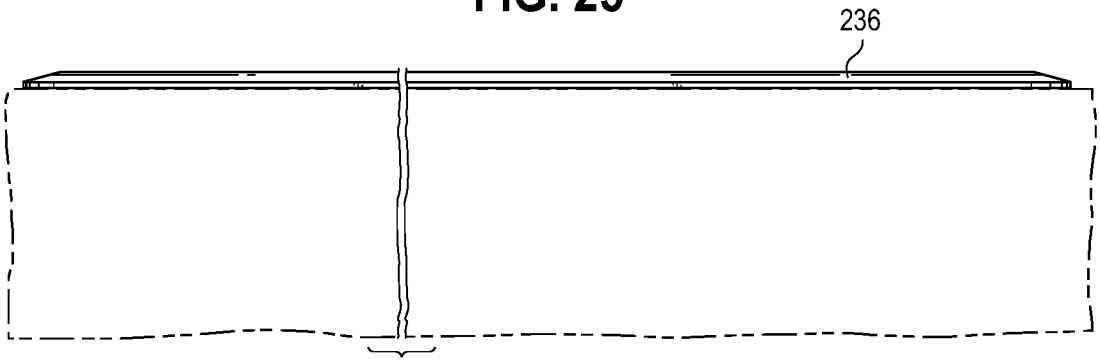
Figure 26:
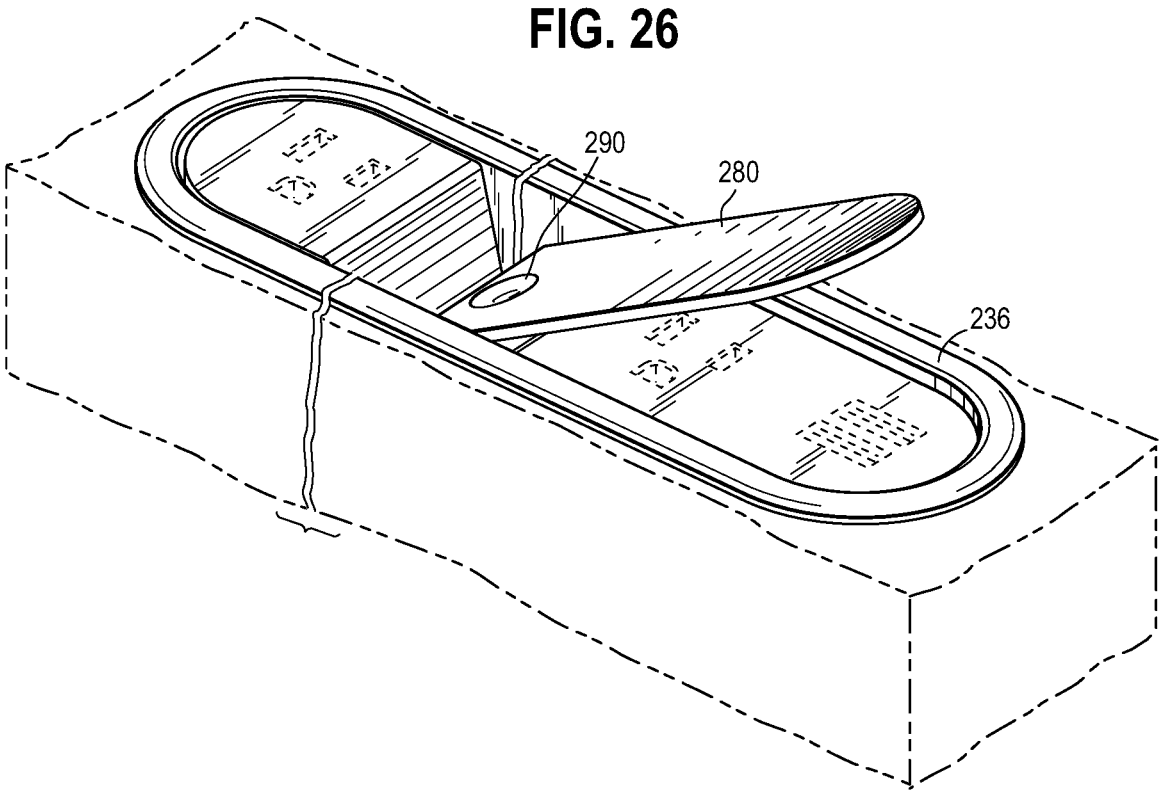
FIGS. 26-30 show, respectively top perspective view, top plan view, end elevation views, and side elevation view of a power grommet with a partially-open lid, illustrated with a generic potential worksurface environment that highlights an ornamental appearance of the power grommet.
Figure 27:
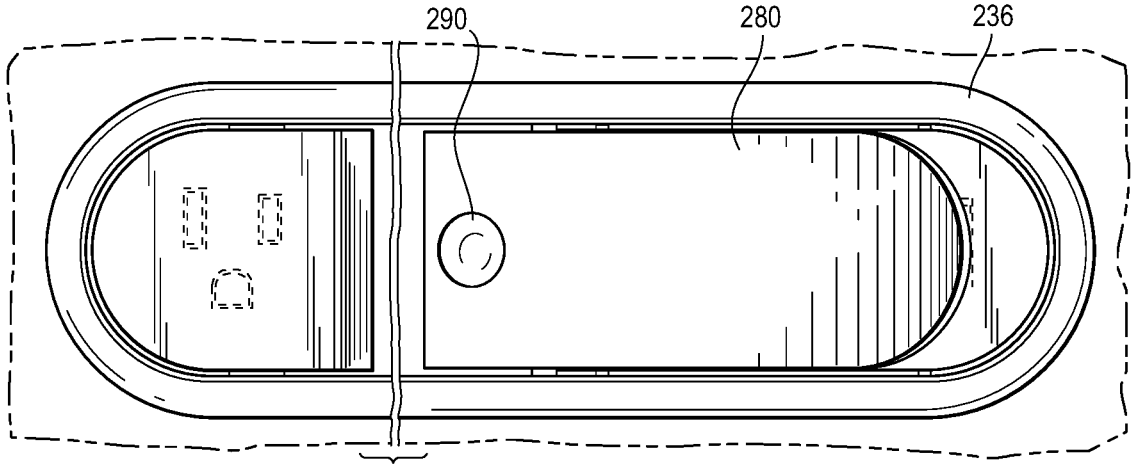
Figure 28:
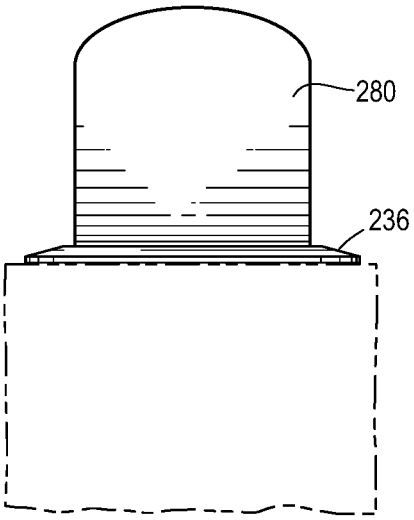
Figure 29:
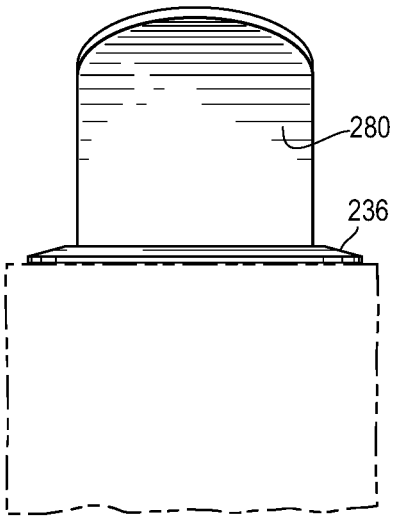
Figure 30:
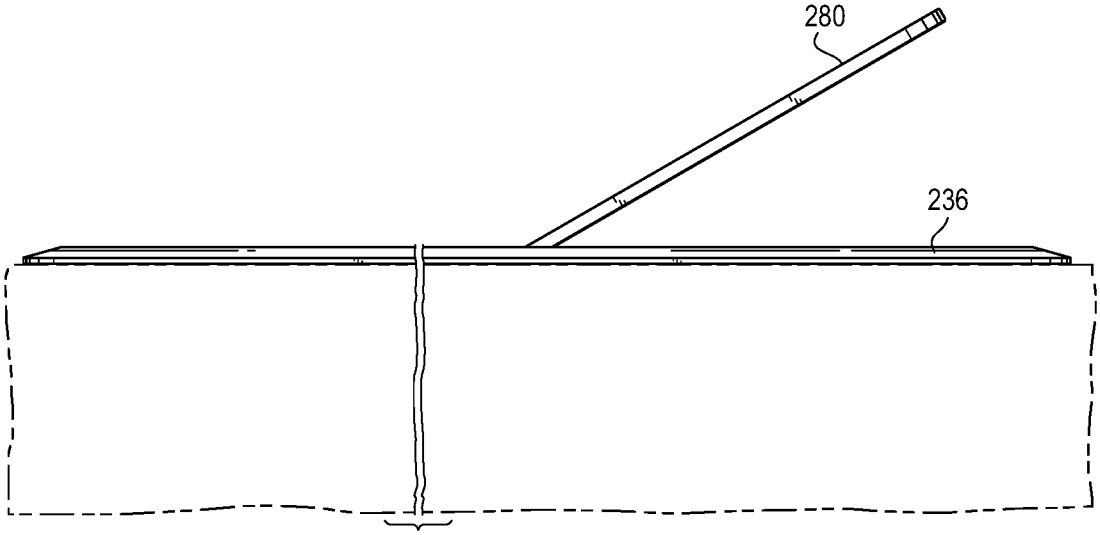
Figure 31:
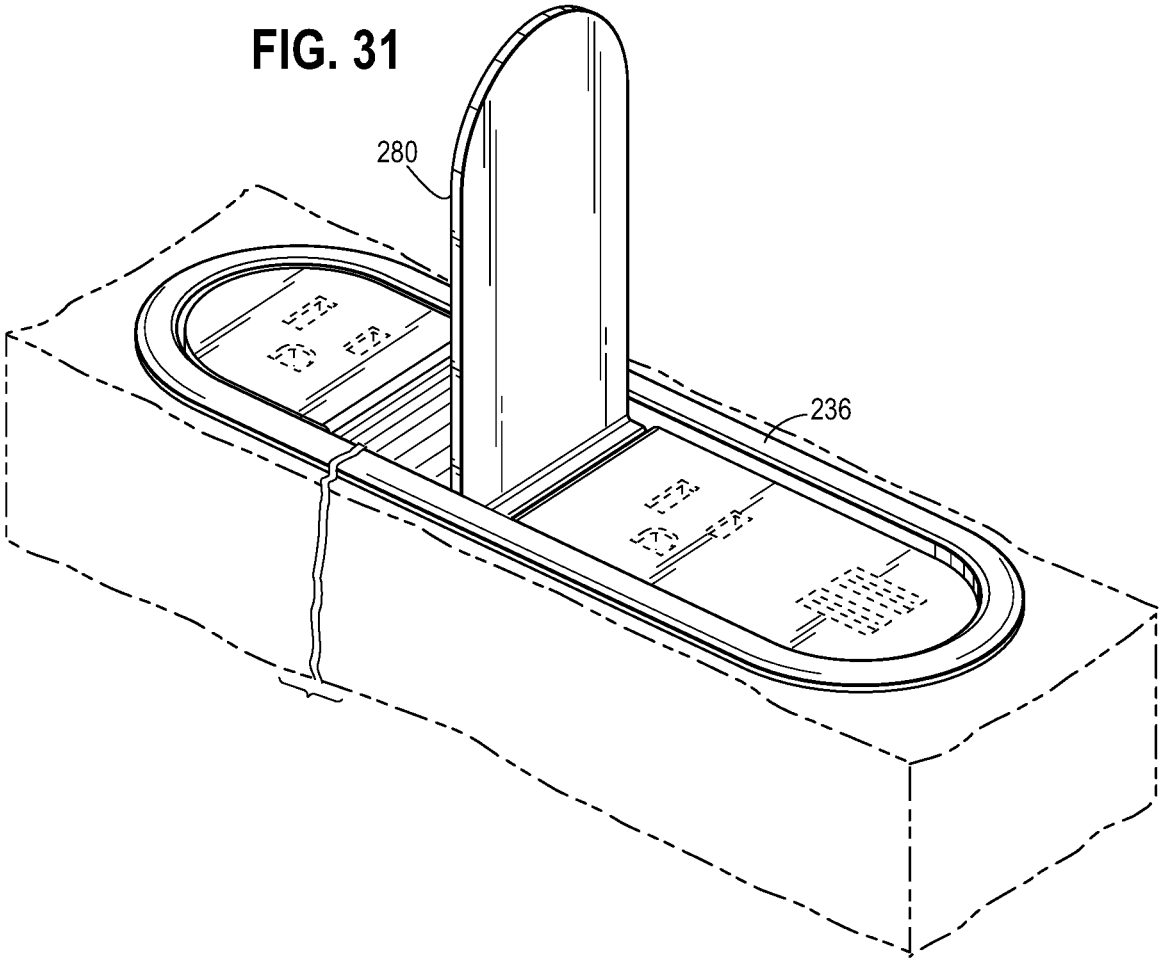
FIGS. 31-35 show, respectively top perspective view, top plan view, end elevation views, and side elevation view of a power grommet with an open lid, illustrated with a generic potential worksurface environment that highlights an ornamental appearance of the power grommet.
Figure 32:
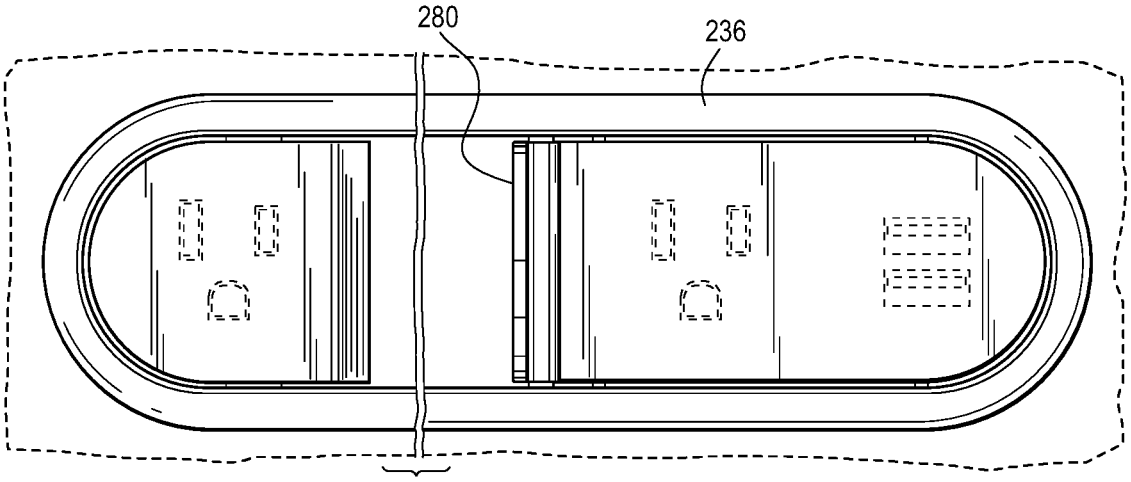
Figure 33:
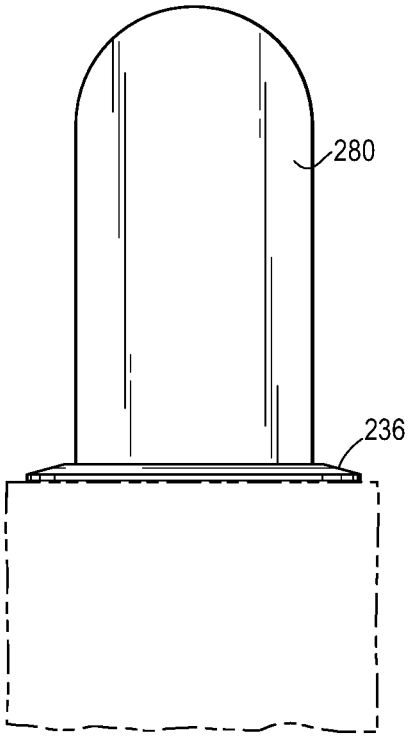
Figure 34:
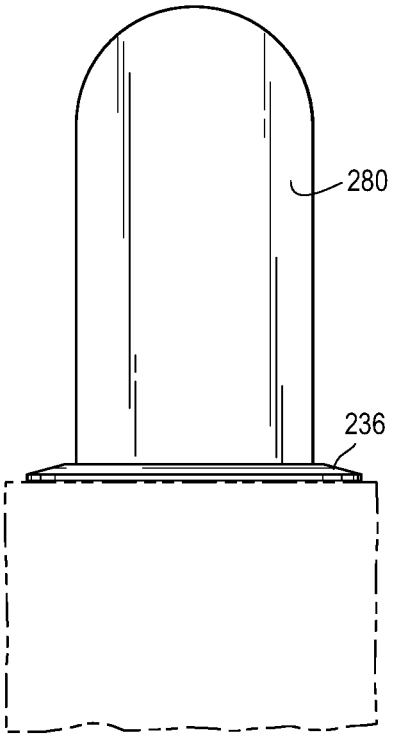
Figure 35:
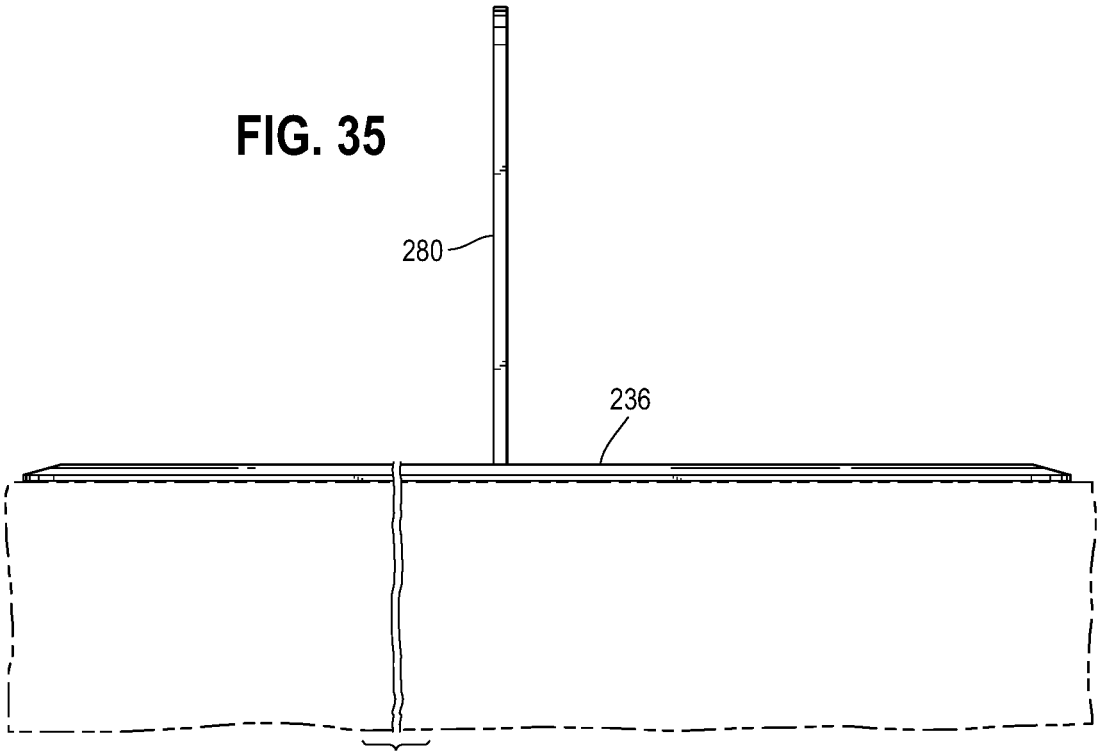
Figure 36A:
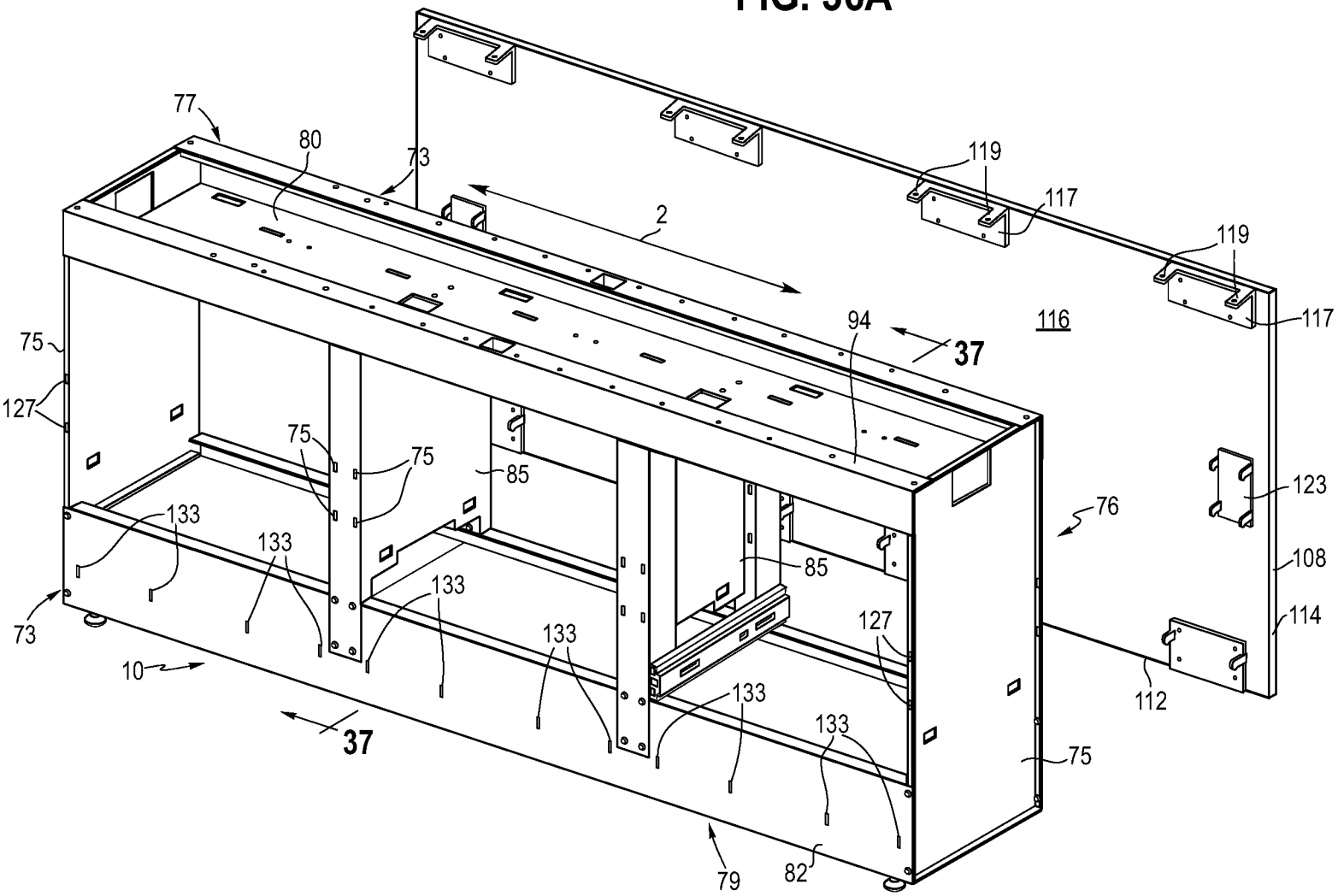
FIGS. 36A-D show perspective views of a base with a skin being coupled thereto.
Figure 36C:
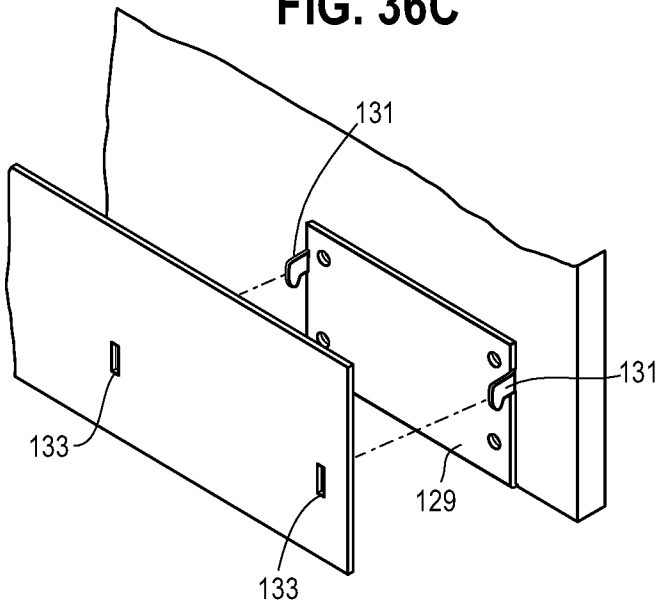
Figure 36D:
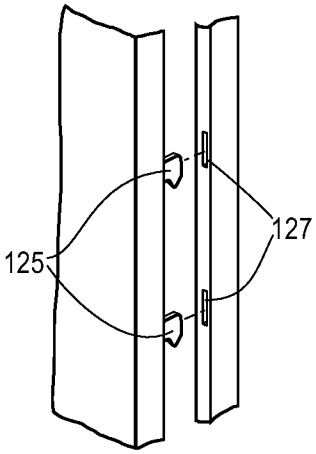
Figure 36B:
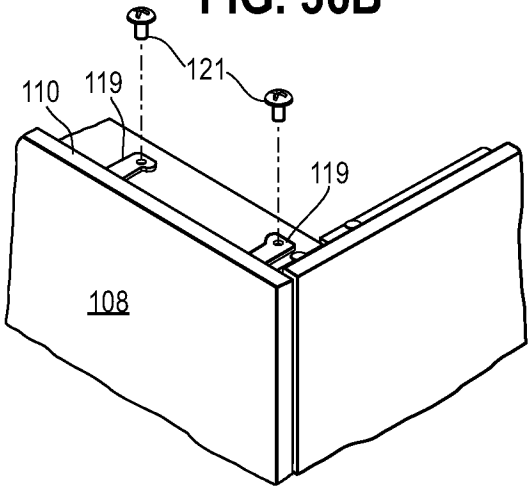

A second outlet block 250 is inserted into the cavity of the housing along an opposite end thereof. The outlet block has a base. A mounting bracket 252 includes a flange 254 extending outwardly from the outer surface of the housing. The mounting flange may be secured to the bottom surface 22 of the worksurface, for example with one or more fasteners. The outlet block is secured to the housing with the insert member 243 engaging a slot 245 and one or more fasteners 247 extending through the side of the housing. The first and second outlet blocks have end walls 258, 260 that are spaced apart in the longitudinal direction 2' to define a gap G4 therebetween, thereby providing a pass-through opening 262 between the outlet blocks from a top of the worksurface to a bottom thereof, and between a top and bottom of the housing, and through the cavity 238 defined by the housing. In this way, power cords 264, cables and other components may be passed through the through opening and stored in the cavity 66 as shown in FIG. 18, or routed to other locations beneath the worksurface. Although it serves those functions, the size of the gap G—both absolute and relative to the first and second outlet blocks 242, 250 and its shape may be selected for visual appeal of the power grommet, such that the rectangular gap shown could be embodied as circular, oval, obround, hexagonal, etc. in other embodiments that would provide the same functionality, but with a different visual appearance.

In one embodiment, the first and second outlet blocks 242, 250 have different numbers of outlets 270, 272, with the first power block having a single outlet, and the second outlet block having first and second outlets. The outlets may be a standard outlet 270, as shown in the first and second outlet blocks, or a USB or USB-C port 272, as shown in the second outlet block. It should be understood that the outlet blocks may have the same number of outlets, which may the same or different types.

In one embodiment, a lid 280 is pivotally coupled to the housing 232 about one or more pivot pins 284 defining a horizontal axis 282, or an axis extending perpendicular to the longitudinal axis of the housing. FIGS. 20-25 show perspective, plan, and elevation views with the lid 280 in a closed position, FIGS. 26-30 show perspective, plan, and elevation views with the lid 280 in a partially-open position, and FIGS. 31-35 show perspective, plan, and elevation views with the lid 280 in an open position where the lid is generally perpendicular to the longitudinal face of the power grommet and a generic surrounding worksurface environment shown in phantom lines. Those figures provide clear illustration of an ornamental design appearance presented by this obround embodiment, although it should be appreciated that other geometric or non-geometric shapes of a power grommet would provide the same functionality contemplated by the power grommet. Dashed lines are used therein to illustrate power outlets, shown here as standard United States grounded 120V outlets and a pair of USB-C ports, which highlights that other power outlets, data ports, and/or other plug-in structures may be provided in the blocks 242, 250, including in different orientations than illustrated herein. Also, it will be appreciated—particularly with reference to FIGS. 18 and 31-35 that lidless embodiments are disclosed to those of skill in the art with regard to both functional and ornamental aspects. In addition, it should be understood that the ornamental design appearance extends to the housing and lid alone, without the blocks. Likewise, the ornamental design appearance of the lid extends to the lid without depression 290, which may be omitted altogether, or be configured in other shapes and sizes.

As shown in those drawings, the lid 280 is pivotable between an open position, wherein the first and second outlet blocks, and outlets 270, 272 are exposed along a top of the housing, and a closed position, wherein one of the first or second outlet blocks is exposed along a top of the housing, and the other of the first and second outlet blocks is covered by the lid. In this way, at least one power block is always exposed and readily accessible without requiring actuation of the lid, with the exposed outlet providing indicia to the user that power is available. The lid may greater than 90°, for example 95°, between the closed and open positions, such that the lid is over center in the open position. The lid has an elongated portion 286 extending from the axis in a first direction, with the elongated portion overlying the outlets. The lid also includes an engageable actuator portion 288 extending from the axis in a second direction opposite the first direction. The actuator portion is shorter than the elongated portion in one embodiment. In one embodiment, the lid covers more than ½ of a top of the cavity when in the closed position.

The pin acts as a fulcrum, with a force being applied to the actuator portion causing the lid to pivot about the axis 282. The actuator portion may be provided with indicia notifying the user of where to engage the lid, such as thumb depression 290. When in the over center open position, the lid 286 remains open due to gravity applied by the elongated portion, while in the closed position, the lid remains closed due to gravity. The lid may be made of any suitable material, including for example and without limitation metal or plastic.

Referring to FIGS. 41-44, in one embodiment, a pair of hinge/pivot pins or pivot members 284, 284' couple the lid 280 to the housing 232. The pivot members 284, 284' have a body 502 with a pair of axles 506, 506', 504 extending from opposite ends of the body. The pivot members 502 may be made of plastic. In one embodiment, the axles 506, 506', 504 are parallel but spaced apart along longitudinal axes 285 and 500. The axles 506 are rotatable relative to the housing 232 in openings 235 formed in the opposite side walls 234.

Figure 43:
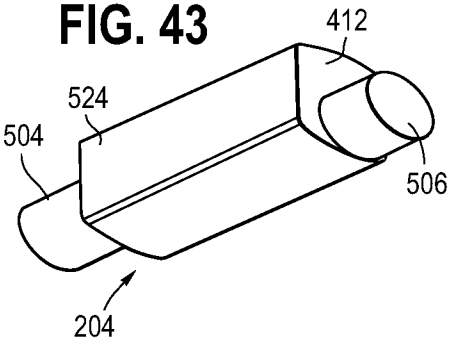
FIG. 43 is a perspective view of a pivot pin with a frictional stop surface.
Figure 42:
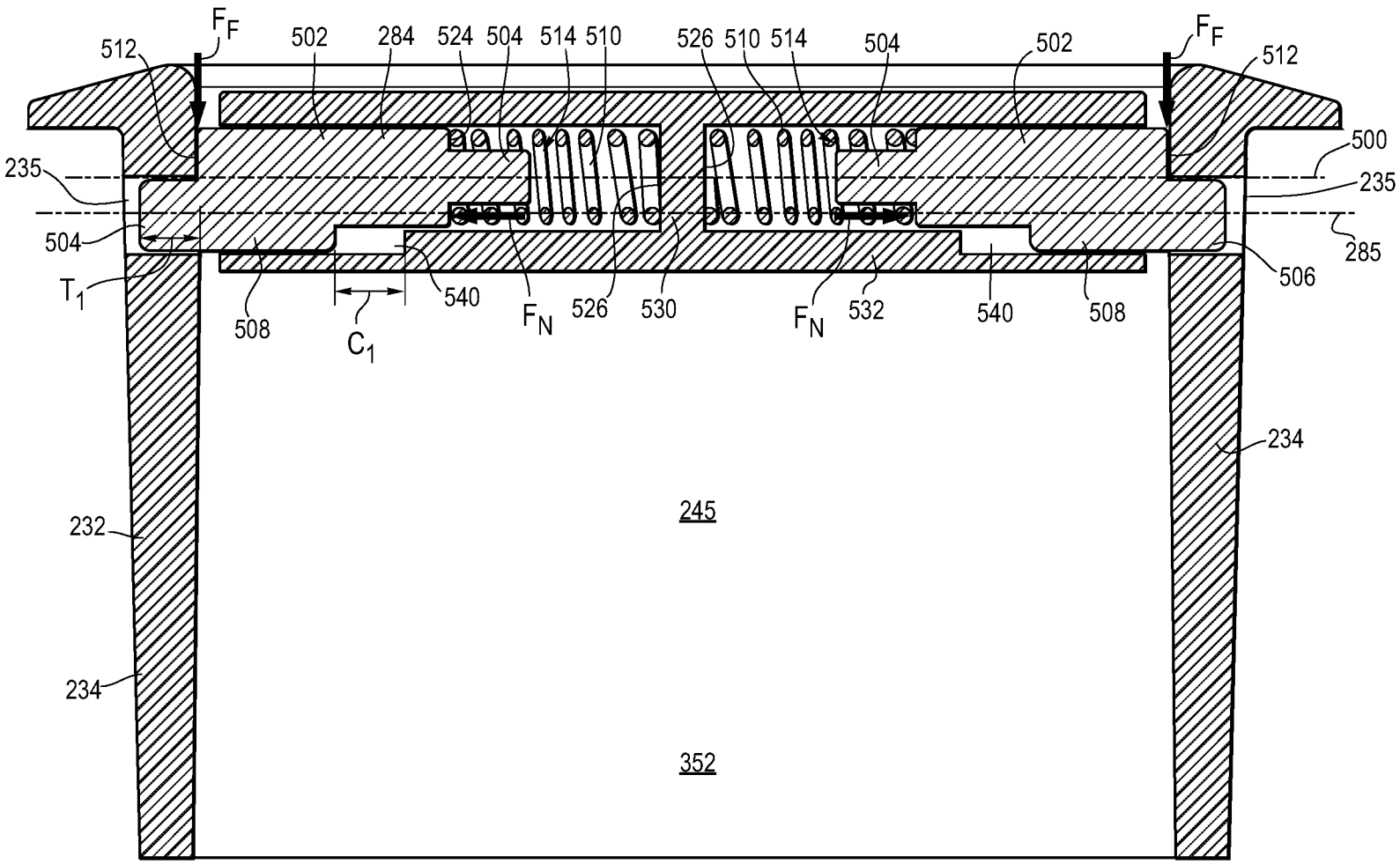
FIG. 42 is a cross-sectional view of the grommet housing and lid shown in FIG. 41.

The lid 280 has a pair of axially aligned cavities formed in a hub portion 532 extending downwardly from the lid, with the cavities being separated by a wall 530 defining a pair of stop surfaces 526. The bodies 502 are non-rotatably fixed to the lid in the cavities. For example, in one embodiment, each body 502 includes a key portion 508 that mates with a corresponding cavity 514 in the lid. In one embodiment, the body 502 has a substantially rectangular cross-section as shown in FIG. 43, with opposing curved sides, that mates with a similar cross-section of the cavity 514. Alternatively, the body has a key portion 516, as shown for example in FIG. 44, extending radially therefrom that mates with a key passageway 522 formed in the cavity 514. For example, the axle 506 may have a profile portion defining the key portion. As shown in FIG. 42, the cavity has a sufficient dead space 540 with a length (C1) which is the same as or greater than the length of the axle 506/hole 235 interface (T1), such that the pivot members 284 may be depressed inwardly (against the force of a spring 510) until the axle 506 clears the side wall 234 and the lid may be removed or disengaged from the housing.

The spring 510 is disposed around the axle 504 and has one end that exerts a compressive force against a biasing surface 524 of the body 502 of the pivot pin 284, with an opposite friction surface 512 engaging an inner surface of the housing side wall 234. An opposite end of the spring 510 engages a stop surface 526 forming an end of each cavity. The spring 510 is shown as a compression spring, but may take other forms, including a leaf spring. The friction (FF) created between the friction surface 512 and housing side wall 234 is sufficient to hold the lid 280 in any open position. In this embodiment, the lid 280 is prevented from closing unexpectedly, but rather requires an assist by the user by pushing on the elongated portion 286 or pulling on the actuator portion 288 to close the lid, or by pushing on the actuator portion 288 to open the lid. By having a pair of pivot members 284 and springs 510 (with equal length and spring rates), the lid 280 is centered between the opposing side walls 234 of the housing, since the pivot members 284 and springs 510 exert equal and opposite forces against the opposite housing side walls 234.

Figure 44:
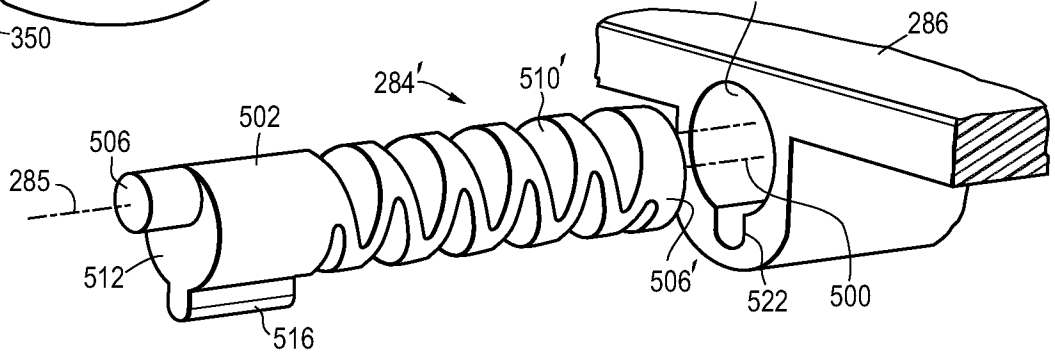
FIG. 44 is an alternative embodiment of the pivot pin with an integrated spring.
Figure 41:
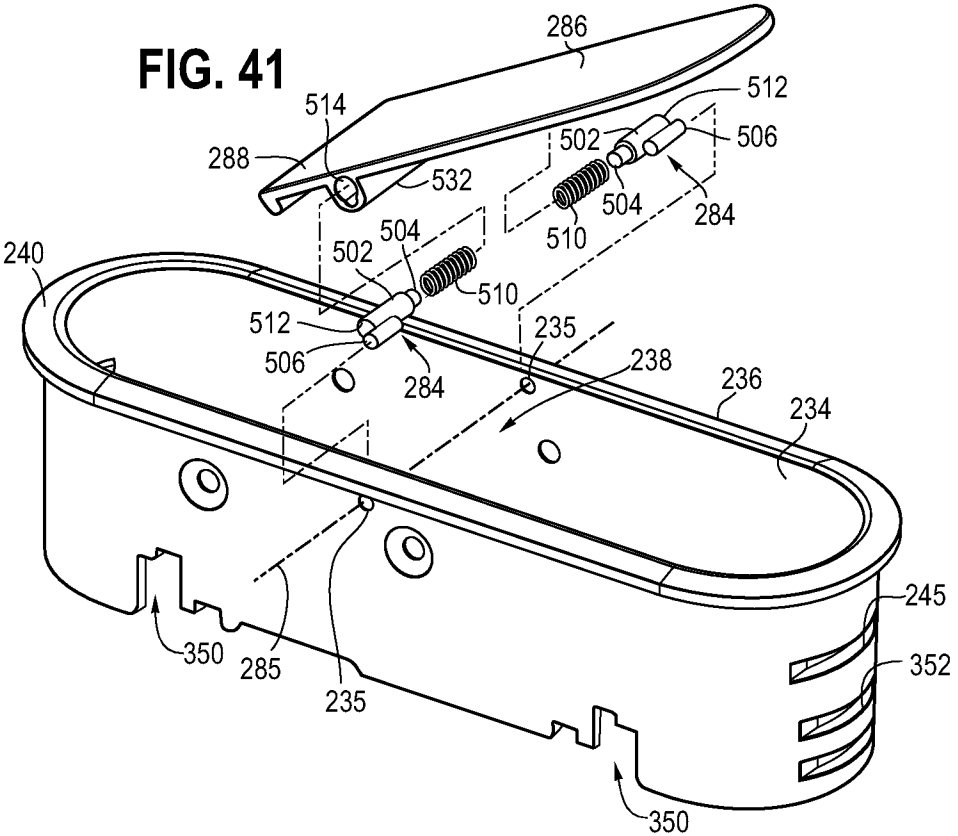
FIG. 41 is an exploded view of the grommet housing and lid shown in FIG. 19B.

As shown in the embodiment of FIG. 44, the axle 506' and the spring 510' may be integrally formed, with the spring 510' and pivot pin being a single, homogenous and integrally formed component.

While the embodiment of the lid 280, housing 232 and pivot member 284 shown in FIGS. 41-44 is applied to grommet housing, it should be understood that the frictional engagement between the pivot member and housing may be applied to any type of enclosure where a housing has a lid pivoting or rotating relative thereto. In operation, the method of accessing the enclosure includes pivoting the lid 280 relative to the housing 232 about the pivot member 284 from a closed position to an angled open position, and exerting an axial (normal) force FN to the pivot member 284 (perpendicular to the side wall 234) and thereby creating a friction force FF between the friction surface 512 of the pivot member and the side wall 234 of the housing sufficient to hold the lid 280 in the angled open position. The static friction force FF is the product of the normal force FN times the coefficient of friction. In addition, when a pair of pivot members 284 are provided, the method further includes applying equal and opposite forces to the lid 280 and housing 232 on each side of thereof such that the lid 280 is centered in the opening defining by the housing along the top 240 thereof.

In order for the lid 280 to maintain position, the moment due to friction (FF) must overcome the moment due to gravity. The bearing friction moment is:

$$M = \frac{\mu_k P}{\pi(R_2^2 - R_1^2)} \int_0^{2\pi} \int_{R_1}^{R_2} r^2 \, dr d\theta$$

That formula may be simplified to:

$$(w * r_1) = \frac{2}{3} * kx * \mu * r_2$$

Where:

w is the weight of the lid 280, $r_1$ is the distance from the Center of Gravity (COG) of the lid 280 to the pivot axis 285, k is the spring constant of the spring 510, x is the distance the spring 510 is compressed, μ the friction coefficient between the pivot member 284 and housing side wall 234, and $r_2$ is the radius of the friction surface 512.

As such, the materials and dimensions of the various components, including the types of material of the lid 280 (affecting the weight thereof), spring 280 (affecting spring rate), housing 232 and pivot member 284 (both affecting coefficient of friction), and the dimensions of the spring, lid and friction surface, may be varied to ensure that a sufficient friction force FF is applied to maintain the lid 280 in any angled position.

Figure 39:
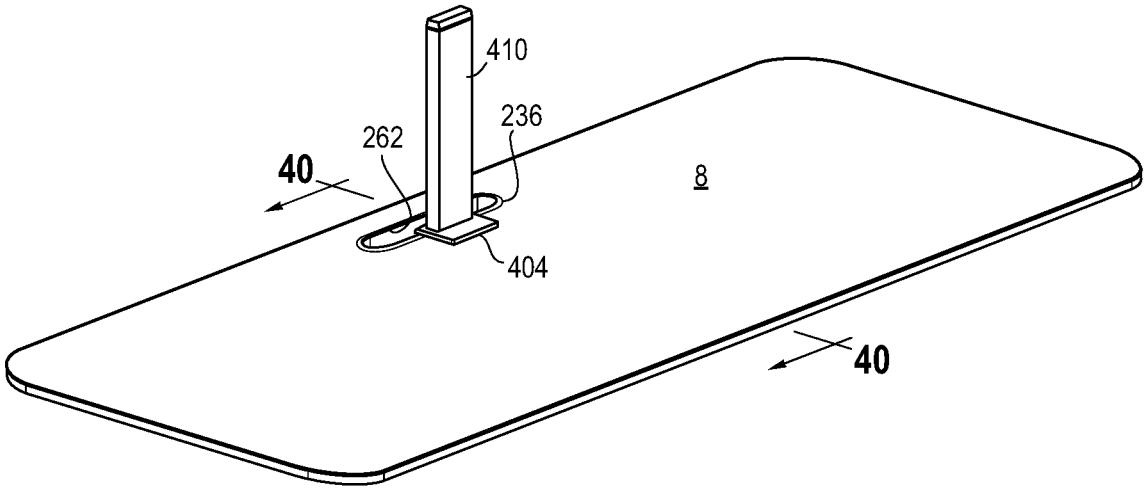
FIG. 39 is a top, perspective view of a worksurface with a monitor support secured thereto.
Figure 40:
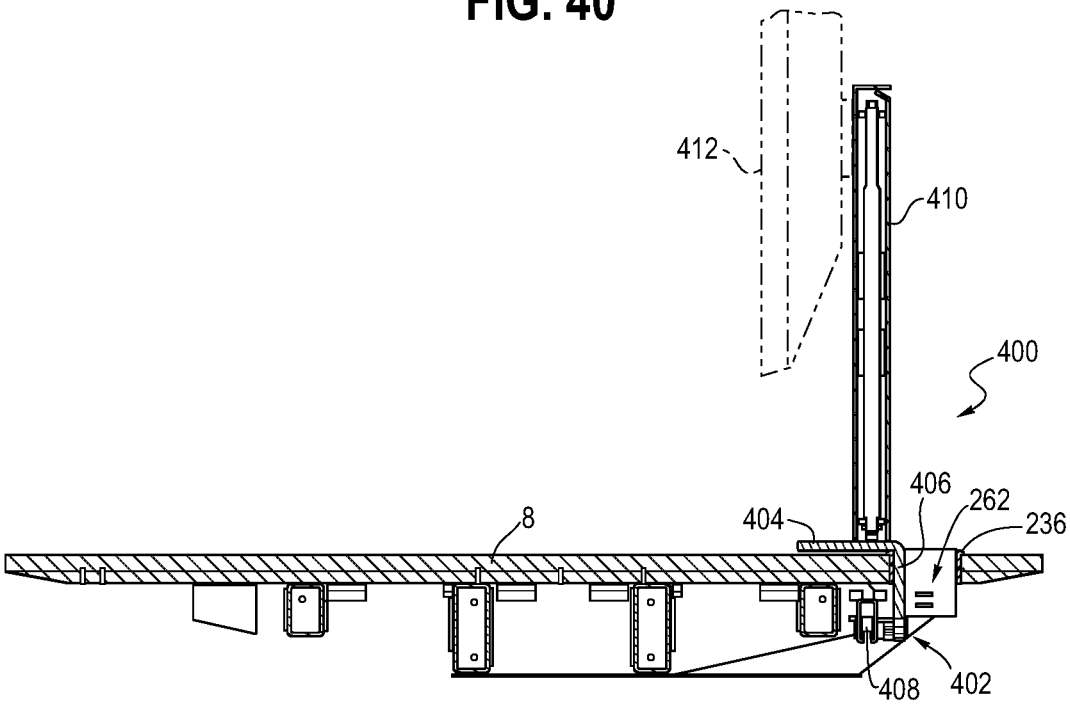
FIG. 40 is a cross sectional view of the monitor support and worksurface taken along line 40-40 in FIG. 39.

Referring to FIGS. 39 and 40, a monitor support 400 includes a base portion 402 extending into the through opening 262. In one embodiment, the base includes a vertical flange 406, a horizontal flange 404 and a clamping component 408 secured to the vertical flange 406 under the work surface. The clamping component 408 is vertically adjustable relative to the horizontal flange 404 such that the distance therebetween may be varied, with the clamping feature being tightened to engage the bottom of the worksurface and the horizontal flange engaging the lip 236 and or top surface of the work surface so as to clamp and secure the monitor support 400 to the worksurface. The monitor support includes an upright 410 extending upwardly from the base 402. A monitor 412, for example an electronic visual display, may be coupled to the upright 410.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A desk comprising:

a frame comprising upper and lower frame members extending in a longitudinal direction and opposite sides spaced apart in a lateral direction;

a skin comprising first and second sides and top and bottom edges, wherein the skin is coupled to the frame with the first side facing one of the opposite sides of the frame;

a height adjustable support column assembly comprising a lower mounting member coupled to the lower frame member, wherein the lower mounting member extends under the bottom edge of the skin, and an upper mounting member coupled to the upper frame member, wherein the upper mounting member extends over the top edge of the skin; and a worksurface coupled to the height adjustable support column assembly and cantilevered outwardly relative to the height adjustable support column assembly.

2. The desk of claim 1 wherein the lower and upper mounting members are releasably coupled to the lower and upper frame members respectively, wherein the height adjustable support column assembly is moveable relative to the frame and skin in the longitudinal direction when the lower and upper mounting members are in a disengaged configuration, and wherein the height adjustable support column assembly is coupled to the frame when the lower and upper mounting members are in an engaged configuration.

3. The desk of claim 2, wherein the lower and upper mounting members are releasably coupled to the lower and upper frame members with fasteners in the engaged configuration.

4. The desk of claim 3, wherein the lower and upper mounting members are moveable to a plurality of mounting positions defined by fastener holes positioned in the lower and upper frame members, wherein the fasteners are engaged with the fastener holes when the lower and upper mounting members are in the engaged configuration.

5. The desk of claim 1 wherein the worksurface is cantilevered outwardly relative to the height adjustable support column assembly such that the worksurface extends in the longitudinal direction parallel to the frame.

6. The desk of claim 1 wherein the worksurface is cantilevered outwardly relative to the height adjustable support column assembly such that the worksurface extends in the lateral direction perpendicular to the frame.

7. The desk of claim 1 further comprising a top disposed above the upper frame member and coupled to the frame.

8. The desk of claim 7, wherein the top is disposed above the top edge of the skin, and wherein the upper mounting member comprises a flange disposed between the top edge of the skin and a bottom surface of the top.

9. The desk of claim 8, wherein the flange comprises a first portion overlying the top edge of the skin and a second portion extending laterally from the first portion and coupled to the upper frame member, wherein the first and second portions are vertically spaced.

10. The desk of claim 9, wherein the top covers the second portion of the flange.

11. The desk of claim 1, wherein the lower mounting member comprises a flange disposed below the bottom edge of the skin.

12. The desk of claim 11, wherein the flange comprises a first portion underlying the bottom edge of the skin and a second portion extending laterally from the first portion and coupled to the lower frame member, wherein the first and second portions are vertically spaced.

13. The desk of claim 1, wherein the height adjustable support column assembly comprises a brace and a height adjustable support column, wherein the brace comprises a vertical frame component spaced apart from the side of the frame and disposed along the second side of the skin, and a horizontal frame component extending laterally outwardly from the vertical frame component, and wherein the height adjustable support column is coupled to the horizontal frame component.

14. The desk of claim 13, wherein the brace is L-shaped.

15. The desk of claim 14 further comprising a vertically extending shroud surrounding the brace and height adjustable support column.

16. The cantilevered desk of claim 1 wherein the worksurface has an elongated opening extending into the worksurface from an upper surface of the worksurface, and further comprising:

a power grommet comprising:

a housing received in the opening of the worksurface, the housing defining an elongated cavity, wherein the cavity is open along a top of the housing;

at least a first and second outlet block disposed in the cavity and accessible through the open top of the housing; and a lid pivotally connected to the housing about a horizontal axis, the lid pivotable between an open position, wherein the first and second outlet blocks are exposed along a top of the housing, and a closed position, wherein the first outlet block is exposed along a top of the housing and the second outlet block is covered by the lid.

17. A desk comprising:

a frame comprising upper and lower frame members extending in a longitudinal direction and opposite sides spaced apart in a lateral direction;

a skin comprising first and second sides and top and bottom edges, wherein the skin is coupled to the frame with the first side facing one of the opposite sides of the frame;

a height adjustable support column assembly comprising a lower mounting member coupled to the lower frame member, wherein the lower mounting member extends under the bottom edge of the skin, and an upper mounting member coupled to the upper frame member, wherein the upper mounting member extends over the top edge of the skin, wherein the lower and upper mounting members are moveable relative to the frame and the skin in the longitudinal direction between a plurality of longitudinally spaced locations; and a worksurface coupled to the height adjustable support column assembly and cantilevered outwardly relative to the height adjustable support column assembly.

18. The desk of claim 17 further comprising a top disposed above the upper frame member and coupled to the frame, wherein the top is disposed above the top edge of the skin, and wherein the upper mounting member comprises a flange disposed between the top edge of the skin and a bottom surface of the top.

19. The desk of claim 18, wherein the flange comprises a first portion overlying the top edge of the skin and a second portion extending laterally from the first portion and coupled to the upper frame member, wherein the first and second portions are vertically spaced.

20. The desk of claim 19, wherein the top covers the second portion of the flange.

21. The desk of claim 17 wherein the lower and upper mounting members are releasably coupled to the lower and upper frame members respectively, wherein the height adjustable support column assembly is moveable relative to the frame and skin in the longitudinal direction when the lower and upper mounting members are in a disengaged configuration, and wherein the height adjustable support column assembly is coupled to the frame when the lower and upper mounting members are in an engaged configuration.

22. The desk of claim 17, wherein the lower mounting member comprises a flange disposed below the bottom edge of the skin.

23. The desk of claim 22, wherein the flange comprises a first portion underlying the bottom edge of the skin and a second portion extending laterally from the first portion and coupled to the lower frame member, wherein the first and second portions are vertically spaced.

24. The desk of claim 17, wherein the height adjustable support column assembly comprises a brace and a height adjustable support column, wherein the brace comprises a vertical frame component spaced apart from the side of the frame and disposed along the second side of the skin, and a horizontal frame component extending laterally outwardly from the vertical frame component, and wherein the height adjustable support column is coupled to the horizontal frame component.

* * * * *